US007382387B2

(12) United States Patent
Ichikawa et al.

(10) Patent No.: US 7,382,387 B2
(45) Date of Patent: Jun. 3, 2008

(54) IMAGE FORMING APPARATUS AND IMAGE DENSITY CORRECTION DEVICE

(75) Inventors: Junichi Ichikawa, Kanagawa (JP); Yoshiki Matsuzaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 63 days.

(21) Appl. No.: 11/448,002

(22) Filed: Jun. 7, 2006

(65) Prior Publication Data

US 2007/0127937 A1 Jun. 7, 2007

(30) Foreign Application Priority Data

Dec. 6, 2005 (JP) ..... 2005-352703

(51) Int. Cl.

| | |
|---|---|
| ***B41J 2/385*** | (2006.01) |
| ***B41J 2/47*** | (2006.01) |
| ***G03G 13/04*** | (2006.01) |
| ***G03G 15/00*** | (2006.01) |
| ***G03G 15/043*** | (2006.01) |

(52) U.S. Cl. ..... 347/131; 347/132; 347/135; 347/253; 347/254; 399/49; 399/51

(58) Field of Classification Search ..... 347/129, 347/131, 132, 135, 225, 247, 250, 253, 354, 347/254; 399/49, 51, 60

See application file for complete search history.

(56) References Cited

U.S. PATENT DOCUMENTS 6,288,733 B1 * 9/2001 Nakazawa et al. ..... 347/131 X
6,750,892 B2 * 6/2004 Suzuki ..... 347/131 X
7,206,068 B2 * 4/2007 Suzuki ..... 399/49 X

FOREIGN PATENT DOCUMENTS

JP A-10-20579 1/1998
JP A-2005-81581 3/2005

* cited by examiner

*Primary Examiner*—Sandra L Brase
(74) *Attorney, Agent, or Firm*—Morgan, Lewis & Bockius LLP

(57) ABSTRACT

An image forming apparatus, having a submodule that causes non-uniformity in density in a slow-scanning direction in accordance with rotation, includes a correction image forming unit that forms an image for density correction, in cooperation with the submodule, a density detector that detects a density of the image for density correction, a correction data generation unit that generates correction data to correct a density distribution based on a density distribution of the image for density correction in a slow-scanning direction detected by the density detector, a phase detector that detects a phase of the submodule, and a mark image forming unit that forms a mark image in synchronization with the phase of the submodule detected by the phase detector, in the image for density correction formed by the correction image forming unit.

20 Claims, 23 Drawing Sheets

IMAGE FORMING APPARATUS AND IMAGE DENSITY CORRECTION DEVICE

CROSS-REFERENCE TO RELATED APPLICATION

This application claims priority under 35 USC 119 from Japanese patent application No. 2005-352703 filed on Dec. 6, 2005, the disclosure of which is incorporated by reference herein.

BACKGROUND

1. Technical Field

The present invention relates to an image forming apparatus such as an electrophotographic copier, a printer, a facsimile machine or the like and an image density correction device used therein.

2. Related Art

As a conventional image forming apparatus, an apparatus having plural submodules such as an photoconductor drum, a charging device, an exposure device, developing device and a transfer device is known. In such image forming apparatus, the rotating photoconductor drum is uniformly charged with the charging device. Next, the surface of the charged photoconductor drum is selectively exposed with the exposure device, thereby an electrostatic latent image is formed on the photoconductor drum. Then the electrostatic latent image formed on the photoconductor drum is developed with the developing device thereby visualized, and an obtained toner image is transferred onto a recording material.

In such image forming apparatus, to suppress density variation of a printed image, a toner image in a predetermined pattern is formed at predetermined timing, and based on the result of detection of the density of the formed toner image, operation parameters of the respective submodules of the image forming apparatus are adjusted. As the operation parameters, a charging bias in the charging device, the quantity of light emitted from the exposure device, a developing bias and a toner supply amount in the developing device, the output of the transfer device and the like can be given.

In the image forming apparatus, a predetermined error is allowed in the photoconductor drum and a photoconductive layer formed on the photoconductor drum. Accordingly, even when the above-described operation parameters are appropriately set, non-uniformity in density may occur in a rotation direction of the photoconductor drum i.e. a slow-scanning direction. Further, in addition to the photoconductor drum, respectively predetermined dimensional errors are allowed in a charging roller provided in the charging device, a developing roller provided in the developing device, a transfer roller provided in the transfer device and the like. Accordingly, these submodules may cause non-uniformity in density in the slow-scanning direction upon image formation.

SUMMARY

According to an aspect of the present invention, an image forming apparatus, having a submodule that causes non-uniformity in density in a slow-scanning direction in accordance with rotation, includes a correction image forming unit that forms an image for density correction, in cooperation with the submodule, a density detector that detects a density of the image for density correction, a correction data generation unit that generates correction data to correct a density distribution based on a density distribution of the image for density correction in a slow-scanning direction detected by the density detector, a phase detector that detects a phase of the submodule, and a mark image forming unit that forms a mark image in synchronization with the phase of the submodule detected by the phase detector, in the image for density correction formed by the correction image forming unit.

BRIEF DESCRIPTION OF THE DRAWINGS

The above and other object, features and advantages of the present invention will become more apparent from the following detailed description when taken in conjunction with the accompanying drawings wherein.

DETAILED DESCRIPTION

Hereinbelow, exemplary embodiments of the present invention will now be described in detail in accordance with the accompanying drawings.

First Exemplary Embodiment

Figure 1:
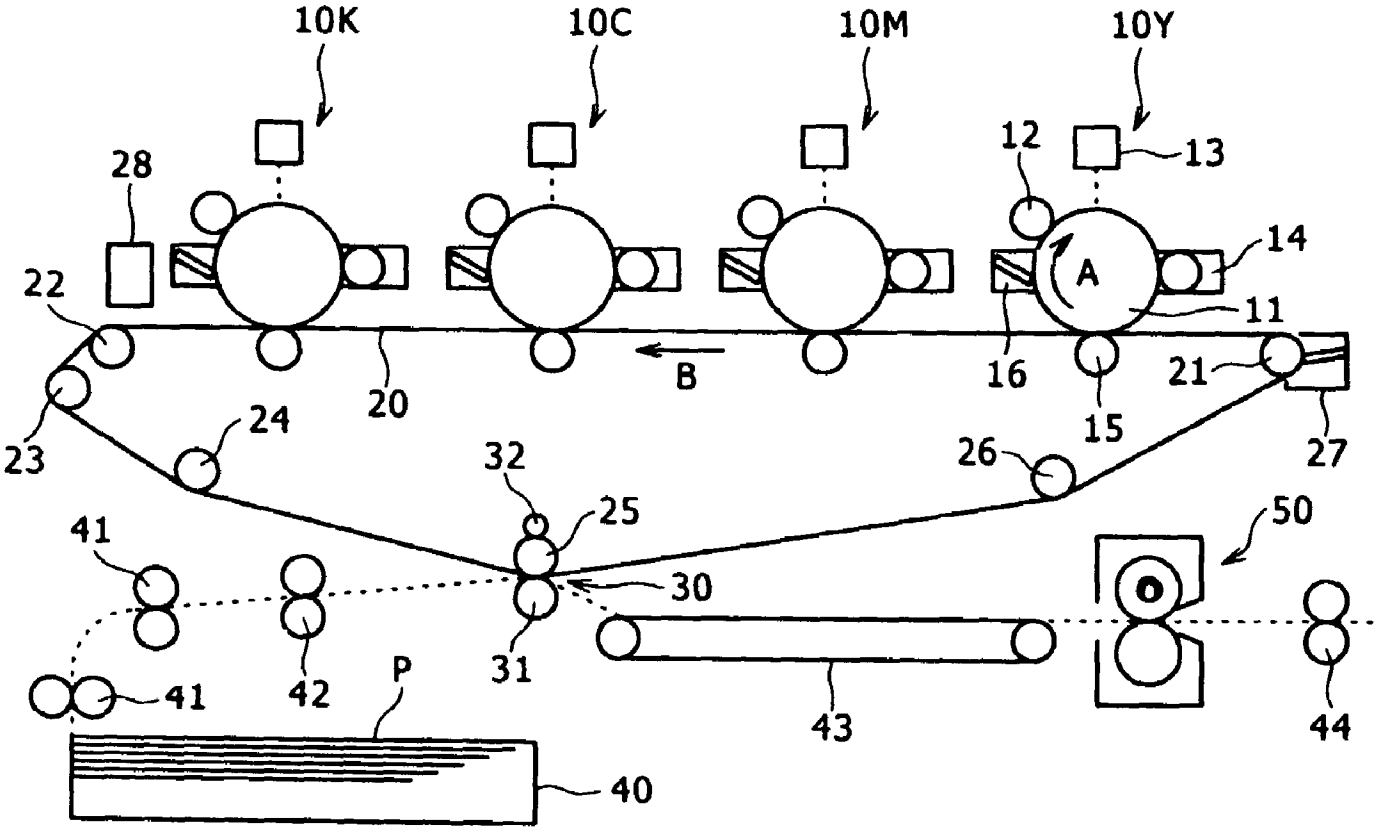
FIG. 1 is an entire block diagram of an image forming apparatus according to a first exemplary embodiment of the present invention.

FIG. 1 is an entire block diagram of an image forming apparatus according to a first exemplary embodiment. The image forming apparatus has plural (four in the present exemplary embodiment) image forming units 10 (10Y, 10M, 10C and 10K) to form respective color component toner images by e.g. an electrophotographic technology. Further, the image forming apparatus has an intermediate transfer belt 20 that carries the color component toner images formed by the respective image forming units 10 and sequentially transferred thereto (first transfer). Further, the image forming apparatus has a second transfer device 30 to transfer (second transfer) the overlapped images transferred on the intermediate transfer belt 20 onto a print sheet P at once. Further, the image forming apparatus has a fixing device 50 to fix the second-transferred image to the print sheet P.

The respective image forming units 10 (10Y, 10M, 10C and 10K) have the same structure except the color of toner. Hereinbelow, the structure of the yellow image forming unit 10Y will be described. The yellow image forming unit 10Y has a photoconductive layer (not shown) and a photoconductor drum 11 provided rotatably in an arrow A direction. A charging roller 12, an exposure part 13, a developing part 14, a first transfer roller 15 and a drum cleaner 16 are provided around the photoconductor drum 11. The charging roller 12, rotatably provided in contact with the photoconductor drum 11, charges the photoconductor drum 11 to a predetermined potential. The exposure part 13 writes an electrostatic latent image with a laser beam on the photoconductor drum 11 charged to the predetermined negative potential by the charging roller 12. The developing part 14, containing corresponding color component toner (yellow toner in the yellow image forming unit 10Y), develops the electrostatic latent image on the photoconductor drum 11 with the toner. The first transfer roller 15 first-transfers the toner image formed on the photoconductor drum 11 onto the intermediate transfer belt 20. The drum cleaner 16 removes residues (toner and the like) on the photoconductor drum 11 after the first transfer.

The intermediate transfer belt 20 is stretched rotatably on plural (six in the present exemplary embodiment) support rollers. Among these support rollers, a driving roller 21 stretches the intermediate transfer belt 20 and drive-rotates the intermediate transfer belt 20. Further, driven rollers 22, 23 and 26 which stretch the intermediate transfer belt 20 and which are rotated in accordance with the rotation of the intermediate transfer belt 20 driven by the driving roller 21. A correction roller 24 stretches the intermediate transfer belt 20, and functions as a steering roller (tilting-movably provided with one end in its axial direction as a support point) to regulate meandering of the intermediate transfer belt 20 in a direction approximately orthogonal to a conveyance direction of the intermediate transfer belt 20. Further, a backup roller 25 stretches the intermediate transfer belt 20, and functions as a constituent element of the second transfer device 30 to be described later.

Further, a belt cleaner 27 to remove residues (toner and the like) on the intermediate transfer belt 20 after the second transfer is provided in a position opposite to the driving roller 21 with the intermediate transfer belt 20 therebetween. Further, a density sensor 28 is provided in a position opposite to the intermediate transfer belt 20. The density sensor 28, provided in a position adjacent to the black image forming unit 10K, detects the densities of respective color toner images first-transferred on the intermediate transfer belt 20.

The second transfer device 30 has a second transfer roller 31 provided in press-contact with a toner image holding surface side of the intermediate transfer belt 20, and the backup roller 25, provided on the rear surface of the intermediate transfer belt 20, as a counter electrode of the second transfer roller 31. A feeding roller 32 to apply a second transfer bias having the same polarity as the charging polarity of the toner is provided in contact with the backup roller 25. On the other hand, the second transfer roller 31 is grounded.

Further, a paper conveyance system has a paper tray 40, a conveyance roller 41, a registration roller 42, a conveyance belt 43, and a discharge roller 44. In the paper conveyance system, the print sheet P stacked on the paper tray 40 is conveyed with the conveyance roller 41, then temporarily stopped with the registration roller 42, thereafter, fed to a second transfer position of the second transfer device 30 at predetermined timing. Further, the print sheet P after the second transfer is conveyed via the conveyance belt 43 to the fixing device 50, and the print sheet P discharged from the fixing device 50 is sent out of the apparatus with the discharge roller 44.

Next, an image forming process of the image forming apparatus will be described. Assuming that a start switch (not shown) is turned on, a predetermined image forming process is performed. More particularly, when the image forming apparatus is used as a digital color copier, first, an original document set on a copy table (not shown) is read by a color image reading device. Next, an obtained read signal is converted to a digital image signal by a processing circuit and temporarily stored in a memory. Then, respective color toner images are formed based on four color (Y, M, C and K) digital image signals stored in the memory. That is, the image forming units 10 (10Y, 10M, 10C and 10K) are respectively driven in correspondence with the respective color digital image signals. Next, each of the image forming units 10 forms an electrostatic latent image by emitting a laser beam corresponding to the digital image signal with the exposure part 13 on the photoconductor drum 11 uniformly charged by the charging roller 12. Then, the electrostatic latent image formed on the photoconductor drum 11 is developed by the developing part 14. Thus respective color toner images are formed. Note that when the image forming apparatus is used as a printer, respective color toner images are formed based on digital image signals inputted from an external device such as a personal computer.

Thereafter, the toner images formed on the respective photoconductor drum 11 are sequentially first-transferred onto the surface of the intermediate transfer belt 20 by the first transfer roller 15 in a first transfer position in which the photoconductor drum 11 is in contact with the intermediate transfer belt 20. On the other hand, residual toner on the photoconductor drum 11 after the first transfer is removed by the drum cleaner 16.

In this manner, the first-transferred toner images are overlapped on the intermediate transfer belt 20, and conveyed to the second transfer position in accordance with the rotation of the intermediate transfer belt 20. On the other hand, the print sheet P is conveyed to the second transfer position at predetermined timing, and the print sheet P is nipped by the second transfer roller 31 with respect to the backup roller 25.

Then, in the second transfer position, the toner image held on the intermediate transfer belt 20 is second-transferred onto the print sheet P by the action of a transfer electric field formed between the second transfer roller 31 and the backup roller 25. The print sheet P on which the toner image has been transferred is conveyed by the conveyance belt 43 to the fixing device 50. In the fixing device 50, the toner image on the print sheet P is heated and press-fixed, then sent to a paper discharge tray (not shown) provided outside the apparatus. On the other hand, residual toner on the intermediate transfer belt 20 after the second transfer is removed by the belt cleaner 27.

Figure 2:
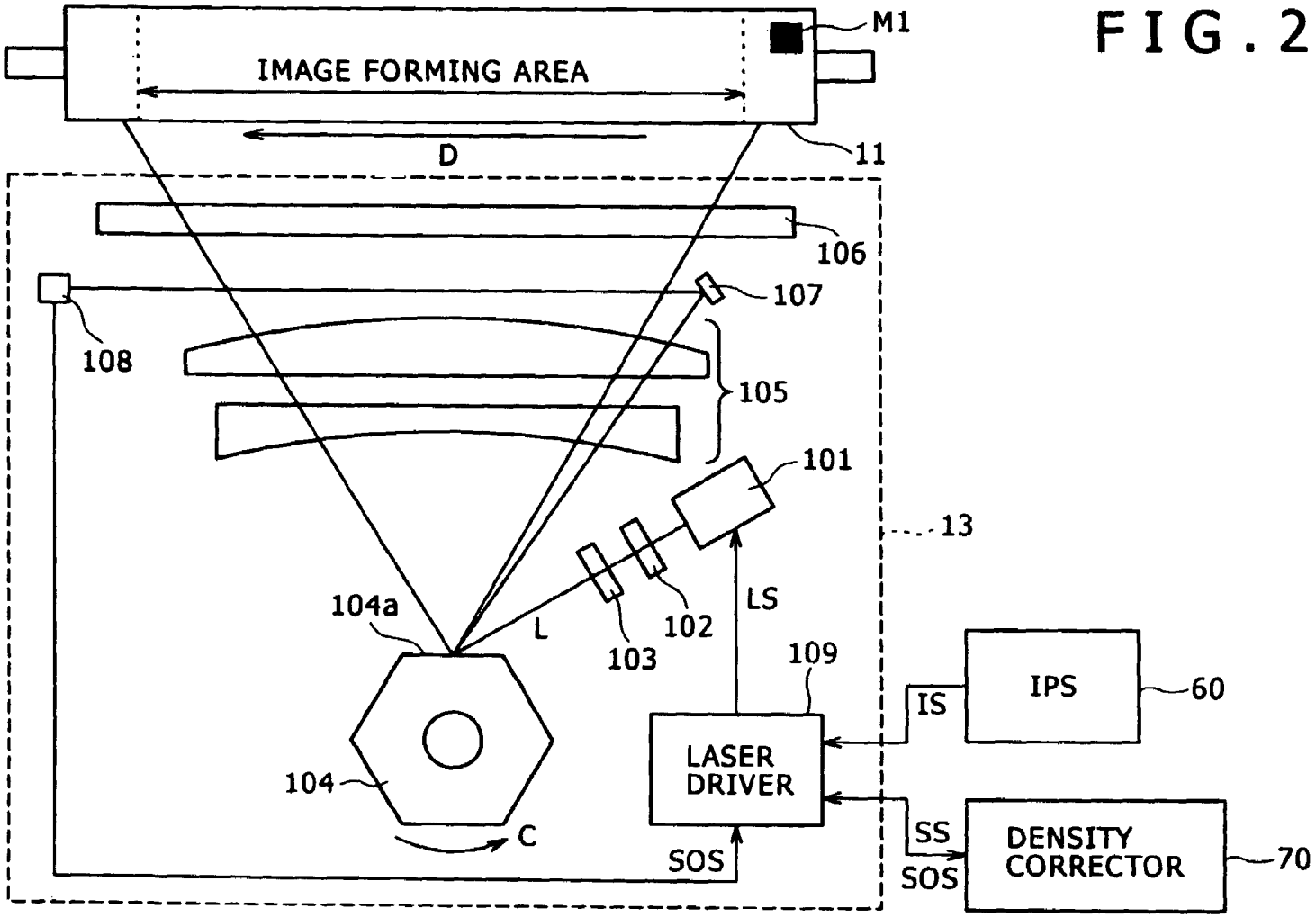
FIG. 2 illustrates the structure of an exposure part and a state of scan exposure on a photoconductor drum by the exposure part.

FIG. 2 illustrates the structure of the exposure part 13 and a state of scan exposure on the photoconductor drum 11 by the exposure part 13. The exposure part 13 has a light source 101 including semiconductor laser, a collimator lens 102, a cylinder lens 103, and a rotating polygon mirror 104 having e.g. a regular hexahedron. Further, the exposure part 13 further has an fθ lens 105, a return mirror 106, a reflecting mirror 107 and a start-of-scan (SOS) sensor 108.

In the exposure part 13 which functions as a correction image forming unit and a mark image forming unit, an emanative laser beam L emitted from the light source 101 is converted to collimated light by the collimator lens 102, then image-formed as a line image along a fast-scanning direction around a deflecting surface 104*a* of the polygon mirror 104 by the cylinder lens 103 having refracting power only in a slow-scanning direction. Then the laser beam L is reflected by the deflecting surface 104*a* of the polygon mirror 104 rotating at a constant high speed, and scanned counterclockwisely (in an arrow C direction) at a constant angular speed. Next, the laser beam L is passed through the fθ lens 105, and turned by the return mirror 106 toward the surface of the photoconductor drum 11, to scan-expose the surface of the photoconductor drum 11 in an arrow D direction. The fθ lens 105 has a function of uniformizing the scanning speed of the light spot of the laser beam L. Further, the above-described line image is formed around the deflecting surface 104*a* of the polygon mirror 104, and the fθ lens 105 image-focuses the light spot on the surface of the photoconductor drum 11 with the deflecting surface 104*a* as an object point regarding the slow-scanning direction. Accordingly, the scanning optical system has a function of correcting tilt of the deflecting surface 104*a*.

Further, prior to scan exposure on the surface of the photoconductor drum 11, the laser beam L enters the SOS sensor 108 via the reflecting mirror 107. That is, upon scanning of the surface of the photoconductor drum 11 with the laser beam L, the initial laser beam L in each scanning line enters the SOS sensor 108. Then the SOS sensor 108 detects emitting timing by scanning line on the surface of the photoconductor drum 11, and generates a start-of-scan (SOS) signal indicating emission start timing.

The light source 101 is connected to a laser driver 109 to output a laser driving signal LS corresponding to an image signal IS as writing image data outputted from an image signal processing system (IPS) 60. The laser driver 109 ON/OFF controls the semiconductor laser of the light source 101 based on the image signal IS from the IPS 60. Thus the laser beam L corresponding to the image signal IS is outputted from the light source 101.

Further, the laser driver 109 is connected to the SOS sensor 108, and the SOS signal generated in the SOS sensor 108 is inputted into the laser driver. Then the laser driver 109 sets timing of starting output of the laser driving signal LS for the semiconductor laser of the light source 101 based on the SOS signal from the SOS sensor 108.

Further, the laser driver 109 is connected to a density corrector 70 as a correction data generating unit. The density corrector 70 generates a light quantity setting signal SS (light quantity correction data) to suppress non-uniformity in density in the slow-scanning direction caused by the respective plural units including the photoconductor drum 11 and the developing roller (to be described later) in the developing part 14 (see FIG. 1), and outputs the signal to the laser driver 109. The laser driver 109 controls the light quantity of the laser beam L outputted from the semiconductor laser of the light source 101 based on the light quantity setting signal SS from the density corrector 70. Note that as described later, the light quantity control of the laser beam L is performed between detection of the SOS signal and actual scan exposure on the surface of the photoconductor drum 11.

In this manner, in the present exemplary embodiment, the exposure part 13 is operated based on the light quantity setting signal SS set by the density corrector 70, thereby non-uniformity in density in the slow-scanning direction is suppressed. Then, the density corrector 70 obtains the state of occurrence of non-uniformity in density in the slow-scanning direction at appropriate timing, and sets plural light quantity correction data pieces to generate the light quantity setting signal SS in correspondence with the obtained state. To generate such light quantity correction data, the SOS signal is inputted into the density corrector 70 via the laser driver 109.

Figure 3:
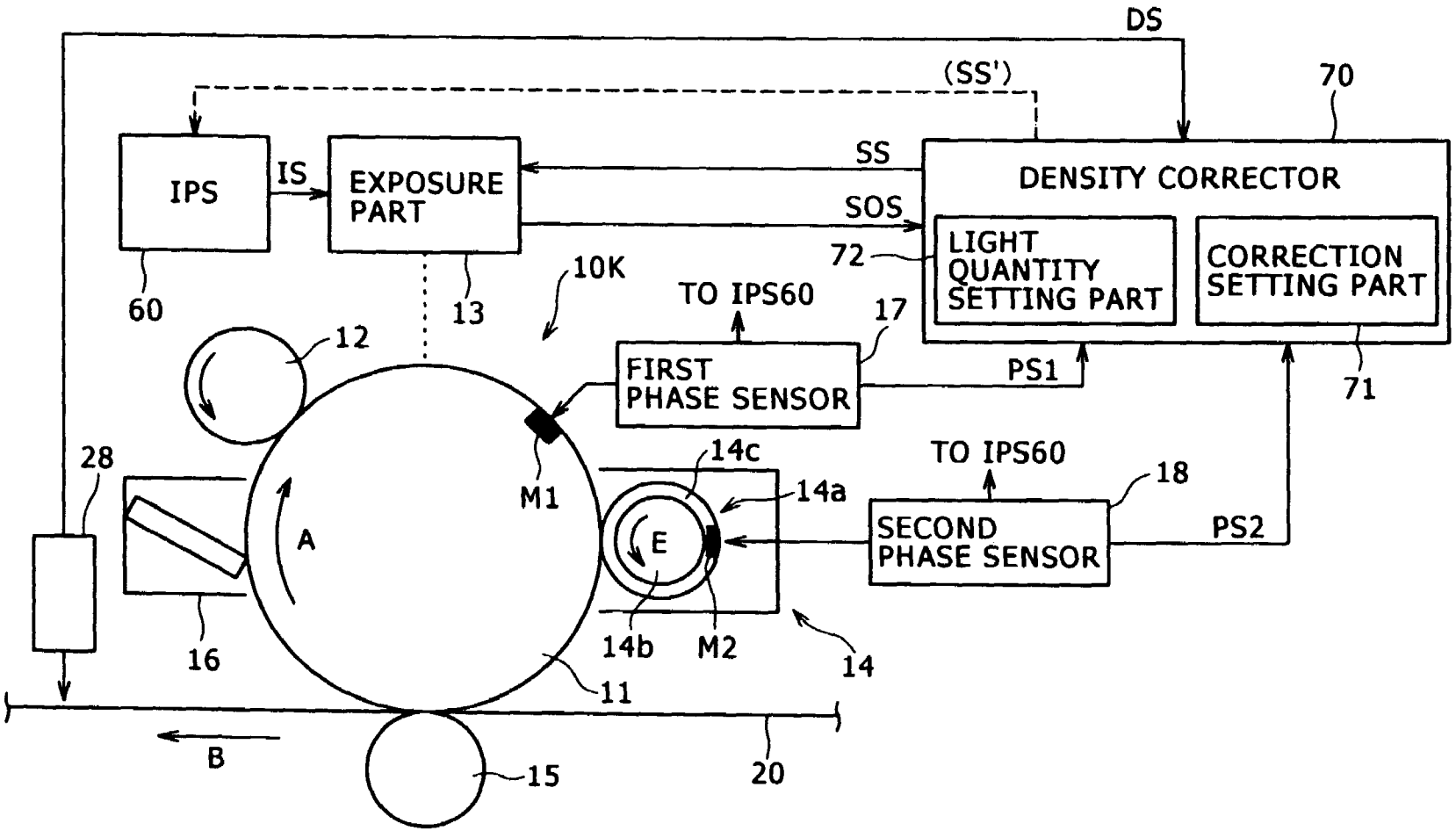
FIG. 3 is a block diagram for explaining various signal inputs/outputs with respect to a density corrector.

Next, the setting of the plural light quantity correction data pieces and the generation of the light quantity setting signal SS in the density corrector 70 will be described in detail. FIG. 3 is a block diagram for explaining various signal inputs/outputs with respect to the density corrector 70. Note that FIG. 3 shows only the black image forming unit 10K, however, the other image forming units 10Y, 10M and 10C are also connected to the density corrector 70.

In the present exemplary embodiment, the density corrector 70 has a correction setting part 71 and a light quantity setting part 72. The correction setting part 71 sets plural (two in the present exemplary embodiment) light quantity correction data pieces to be used for generation of the light quantity setting signal SS. On the other hand, the light quantity setting part 72 generates the light quantity setting signal SS based on the plural light quantity correction data pieces set by the correction setting part 71.

A first mark M1 is formed on the surface of the photoconductor drum 11 as a submodule. The first mark M1 is formed, e.g., outside an image forming area (an area where electrostatic latent image and toner image can be formed) on the photoconductor drum 11 as shown in FIG. 2. Further, regarding the photoconductor drum 11, a first phase sensor 17 as a phase detector to detect the first mark M1 is provided in a position opposite to the first mark M1. The first phase sensor 17 detects the first mark M1 upon each rotation of the photoconductor drum 11. Then the first phase sensor 17 outputs the result of detection of the first mark M1 as a first phase signal PS1 to the density corrector 70. Note that the first phase sensor 17 also outputs the first phase signal PS1 to the IPS 60.

Further, the developing part 14 has a developing roller 14*a* which holds toner (not shown) and conveys the toner to a developing area opposite to the photoconductor drum 11. The developing roller 14*a* has a fixedly-provided magnet roller 14*b* having plural magnetic poles arranged on its surface and a developing sleeve 14*c* as a submodule rotatably attached on the outer peripheral surface of the magnet roller 14*b*. In the developing part 14, two-component developer including toner and carrier is used. The two-component developer is held on the developing sleep 14*c* by a magnetic force acting between the carrier and the magnet roller 14*b*, and conveyed in accordance with the rotation of the developing sleeve 14*c*. In the present exemplary embodiment, the developing sleeve 14*c* is driven in a direction E the same as a direction A as a moving direction of the photoconductor drum 11 in a position opposite to the photoconductor drum 11. A second mark M2 is formed on the surface of the developing sleeve 14*c*. The second mark M2 is formed outside a portion opposite to the image forming area of the photoconductor drum 11. Further, regarding the developing roller 14*a* (developing sleeve 14*c*), a second phase sensor 18 as a phase detector to detect the second mark M2 is provided in a position opposite to the developing roller. The second phase sensor 18 detects the second mark M2 upon each rotation of the developing sleeve 14*c*. Then the second phase sensor 18 outputs the result of detection of the second mark M2 as a second phase signal PS2 to the density corrector 70. Note that the second phase sensor 18 also outputs the second phase signal PS2 to the IPS 60.

Note that the first mark M1 and the second mark M2 can be formed by painting parts of the surface of the photoconductor drum 11 and the developing sleeve 14*c* as shown in the figure, however, may be formed by other methods. For example, the surface state (e.g., surface roughness) of parts of the surface of the photoconductor drum 11 and the developing sleeve 14*c* may be changed, or notches may be formed on end sides of the drum and the sleeve.

Further, the rotational periods of the photoconductor drum 11 and the developing sleeve 14*c* may be obtained by providing sensors to detect driving torque of the photoconductor drum 11 and that of the developing sleeve 14*c*, or counting the number of pulse signals of motors to drive the photoconductor drum 11 and the developing sleeve 14*c*, in place of reading marks with sensors.

Further, the density sensor 28 which functions as a density detector detects the density of a toner image first-transferred on the intermediate transfer belt 20, and outputs a density detection signal DS as the result of detection to the density corrector 70.

The exposure part 13 outputs the SOS signal generated by the SOS sensor 108 (see FIG. 2) to the density corrector 70. On the other hand, the density corrector 70 outputs the generated light quantity setting signal SS to the exposure part 13.

Figure 4:
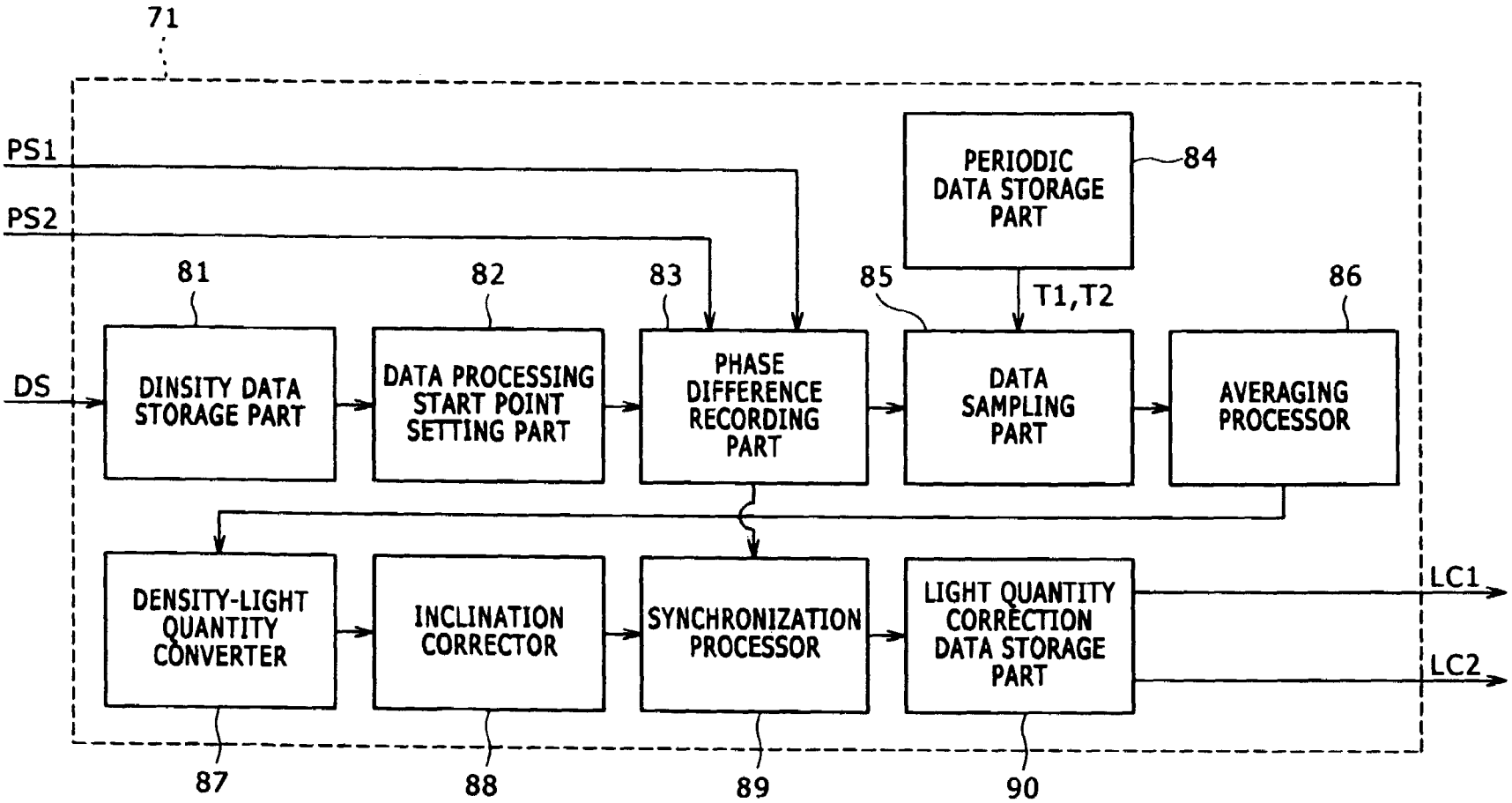
FIG. 4 is a block diagram showing the configuration of a correction setting part in the density corrector.

FIG. 4 is a block diagram showing the configuration the correction setting part 71 in the density corrector 70 shown in FIG. 3. The correction setting part 71 has a density data storage part 81, a data processing start point setting part 82, a phase difference recording part 83, a periodic data storage part 84 and a data sampling part 85. Further, the correction setting part 71 has an averaging processor 86, a density-light quantity converter 87, an inclination corrector 88, a synchronization processor 89 and a light quantity correction data storage part 90.

The density data storage part 81 holds the density detection signal DS inputted from the density sensor 28 (see FIG. 3) as density data arrayed in the slow-scanning direction. Further, the data processing start point setting part 82 sets a data processing start point to obtain first light quantity correction data LC1 and second light quantity correction data LC2, both to be described later, from the density data read from the density data storage part 81. The phase difference recording part 83 calculates a phase difference (first phase difference) between the data processing start point set by the data processing start point setting part 82 and the first phase signal PS1 inputted from the first phase sensor 17, and records the obtained first phase difference in its internal memory. Further, the phase difference recording part 83 calculates a phase difference (second phase difference) between the above data processing start point and the second phase signal PS2 inputted from the second phase sensor 18, and records the obtained second phase difference in its internal memory.

The periodic data storage part 84 holds the period of one rotation of the photoconductor drum 11 (in the following description, referred to as a "first period T1") and the period of one rotation of the developing sleeve 14*c* (in the following description, referred to as a "second period T2"). The first period T1 and the second period T2 are previously determined based on the outer diameters and respective rotational speeds of the photoconductor drum 11 and the developing sleeve 14*c*. The data sampling part 85 reads the first period T1 and the second period T2 stored in the periodic data storage part 84. Then the data sampling part 85 samples density data (referred to as "first density data") for plural rotations (plural first periods T1) of the photoconductor drum 11 by the first period T1, with the above data processing start point as a base point, from the input density data. Further, the data sampling part 85 samples density data (referred to as "second density data") for plural rotations (plural second periods T2) of the developing sleeve 14*c* by the second period T2, with the above data processing start point as a base point, from the input density data.

The averaging processor 86 averages the plural first density data pieces inputted from the data sampling part 85 by the same portion on the photoconductor drum 11. Further, the averaging processor 86 averages the plural second density data pieces inputted from the data sampling part 85 by the same portion on the developing sleeve 14*c*. The density-light quantity converter 87 converts the first density data averaged by the averaging processor 86 to light quantity data (referred to as "first light quantity correction data before inclination correction"). Further, the density-light quantity converter 87 converts the second density data averaged by the averaging processor 86 to light quantity data (referred to as "second light quantity correction data before inclination correction"). The inclination corrector 88 performs inclination correction on the first light quantity correction data before inclination correction, inputted from the density-light quantity converter 87, and outputs the result of the processing as first light quantity correction data before synchronization processing. Further, the inclination corrector 88 performs inclination correction on the second light quantity correction data before inclination correction, inputted from the density-light quantity converter 87, and outputs the result of the processing as second light quantity correction data before synchronization processing.

The synchronization processor 89 links and synchronizes the first light quantity correction data before synchronization processing, sent from the inclination corrector 88, to the first phase difference recorded in the phase difference recording part 83. That is, the synchronization processor 89 determines the position of the first light quantity correction data before synchronization processing corresponding to the position where the first mark M1 is formed on the photoconductor drum 11. Then, the synchronization processor 89 performs rearrangement (change of origin in correspondence with phase difference) of the first light quantity correction data before synchronization processing in accordance with the result of determination, as first light quantity correction data LC1. Further, the synchronization processor 89 links and synchronizes the second light quantity correction data before synchronization processing, sent from the inclination corrector 88, to the second phase difference recorded in the phase difference recording part 83. That is, the synchronization processor 89 determines the position of the second light quantity correction data before synchronization processing corresponding to the position where the second mark M2 is formed on the developing sleeve 14*c*. Then, the synchronization processor 89 performs rearrangement (change of origin in correspondence with phase difference) of the second light quantity correction data before synchronization processing in accordance with the result of determination, as second light quantity correction data LC2.

Then the light quantity correction data storage part 90 holds the first light quantity correction data LC1 and the second light quantity correction data LC2. The first light quantity correction data LC1 and the second light quantity correction data LC2 stored in the light quantity correction data storage part 90 are outputted in response to a request from the light quantity setting part 72 (see FIG. 3).

Figure 5:
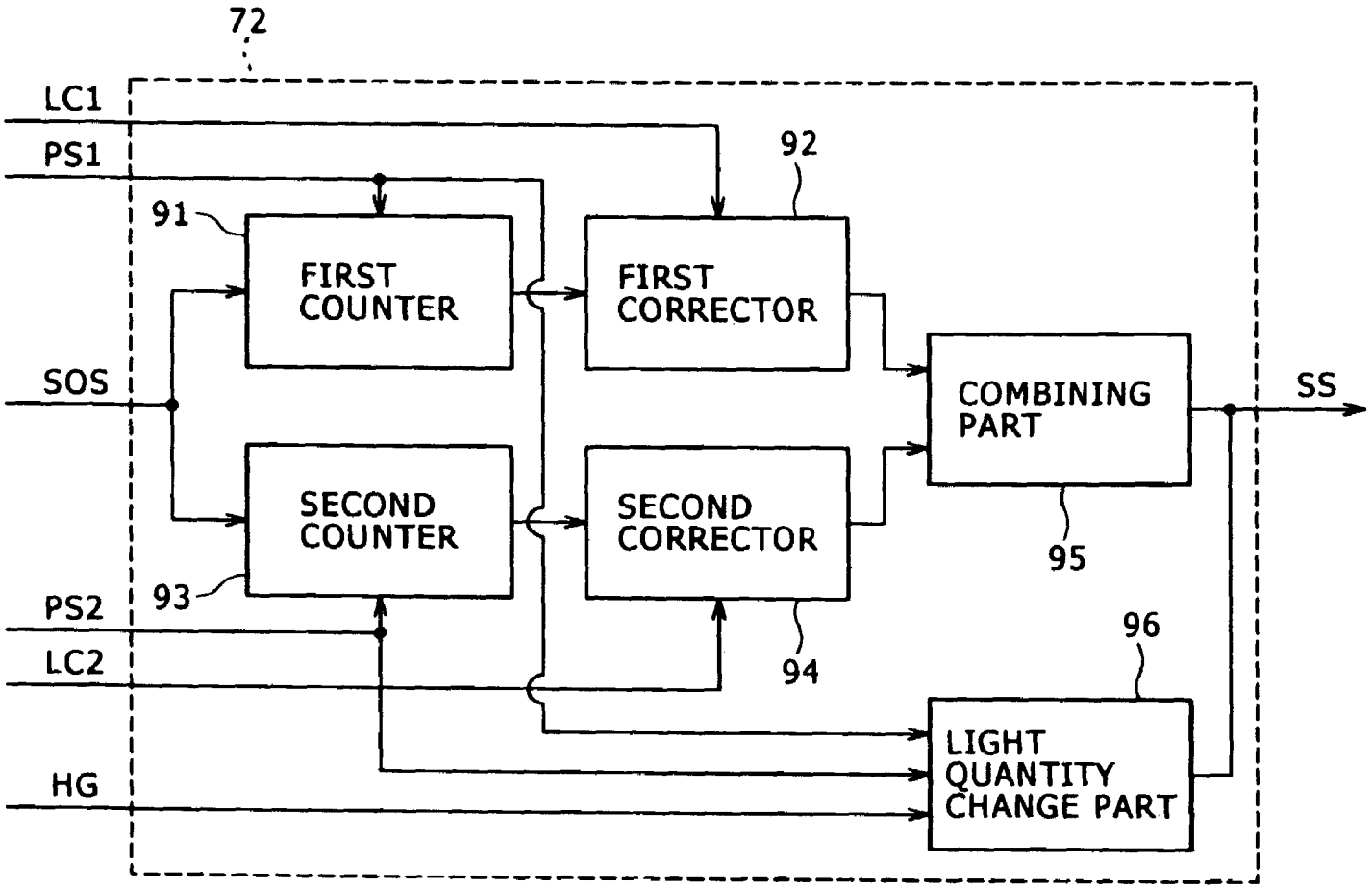
FIG. 5 is a block diagram showing the configuration of a light quantity setting part in the density corrector.

FIG. 5 is a block diagram showing the configuration of the light quantity setting part 72 in the density corrector 70 shown in FIG. 3. The light quantity setting part 72 has a first counter 91, a first corrector 92, a second counter 93, a second corrector 94, a combining part 95 and a light quantity change part 96.

The first counter 91 counts the number of SOS signals inputted from the SOS sensor 108 (see FIG. 2). Further, the first phase signal PS1 is inputted into the first counter 91 from the first phase sensor 17 (see FIG. 3). Then in the first counter 91, its count value (referred to as a "first count value") is reset upon each input of the first phase signal PS1. The first corrector 92 refers to the first light quantity correction data LC1 read from the light quantity correction data storage part 90 (see FIG. 4) of the correction setting part 71, and outputs a first correction value corresponding to the first count value inputted from the first counter 91.

The second counter 93 counts the number of SOS signals inputted from the SOS sensor 108 (see FIG. 2). Further, the second phase signal PS2 is inputted into the second counter 93 from the second phase sensor 18 (see FIG. 3). Then in the second counter 93, its count value (referred to as a "second count value") is reset upon each input of the second phase signal PS2. In the present exemplary embodiment, basically, as photoconductor period T1≠developing part period T2 holds, the first count value and the second count value are basically different values. The second corrector 94 refers to the second light quantity correction data LC2 read from the light quantity correction data storage part 90 (see FIG. 4) of the correction setting part 71, and outputs the second correction value corresponding to the second count value inputted from the second counter 93.

The combining part 95 combines the first correction value inputted from the first corrector 92 and the second correction value inputted from the second corrector 94 by addition in a realtime manner, and outputs the combined value as the light quantity setting signal SS as a correction value. Note that in the combining part 95, the first correction value and the second correction value having the same line number in the fast-scanning direction are added in correspondence with the same SOS signal.

The light quantity change part 96 is used for temporary light quantity change, i.e., change of the toner density on the photoconductor drum 11, upon formation of correction image for correction to be described later. An instruction signal HG to instruct formation of correction image is inputted into the light quantity change part 96 from a main body controller (not shown). Further, the first phase signal PS1 from the first phase sensor 17 and the second phase signal PS2 from the second phase sensor 18 are respectively inputted into the light quantity change part 96. The light quantity change part 96 generates the light quantity setting signal SS to change light quantity based on these instruction signal HG, first phase signal PS1 and second phase signal PS2, and outputs the signal SS.

Figure 6:
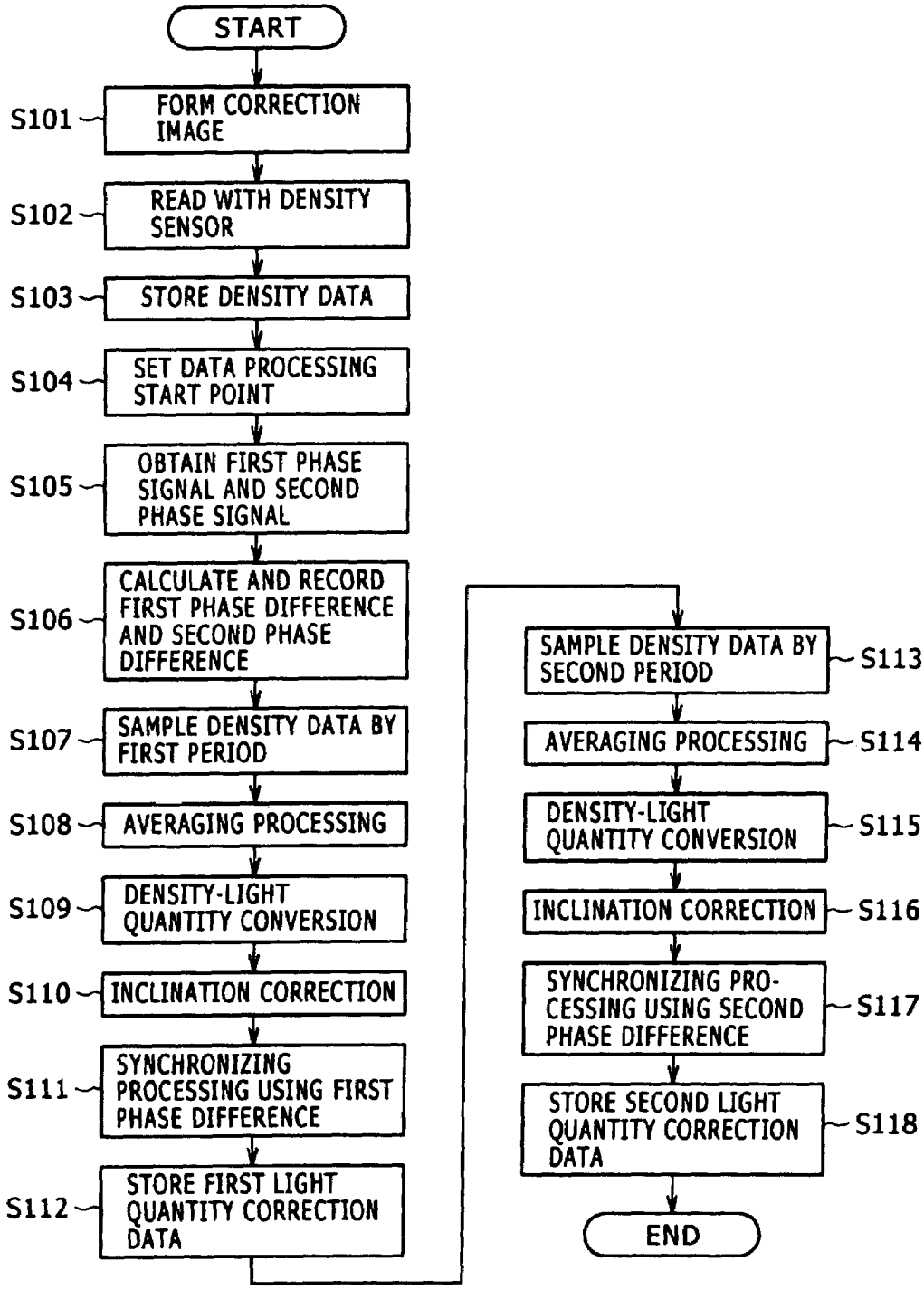
FIG. 6 is a flowchart showing a process of obtaining plural light quantity correction data pieces by the correction setting part.

FIG. 6 is a flowchart showing a process of obtaining plural light quantity correction data pieces (in the present exemplary embodiment, the first light quantity correction data LC1 corresponding to the photoconductor drum 11 and the second light quantity correction data LC2 corresponding to the developing sleeve 14*c*) by the correction setting part 71.

In this processing, first, formation of correction image is performed using the image forming apparatus (step S101). That is, a toner image is formed on the intermediate transfer belt 20 by performing charging, exposure, developing and first transfer. Note that the correction image is basically a halftone image, but the details of the correction image will be described later.

Next, the density of the toner image formed on the intermediate transfer belt 20 is read with the density sensor 28 (step S102), and the obtained density detection signal DS is outputted to the correction setting part 71. The correction setting part 71 receives the signal, and stores the density detection signal DS as density data arrayed in the slow-scanning direction, into the density data storage part 81 (step S103).

Next, the data processing start point setting part 82 sets a data processing start point to obtain the first light quantity correction data LC1 and the second light quantity correction data LC2 to be described later from the density data read from the density data storage part 81 (step S104). Then the phase difference recording part 83 obtains the first phase signal PS1 and the second phase signal PS2 (step S105), and calculates the first phase difference and the second phase difference in the density data using the obtained first phase signal PS1 and second phase signal PS2, and records the first phase difference and the second phase difference (step S106). Further, the data sampling part 85 samples the first density data for plural rotations of the photoconductor drum 1 by each first period T1 from the input density data (step S107). Then the averaging processor 86 averages the plural first density data pieces by the same portion on the photoconductor drum 11 (step S108). Then the density-light quantity converter 87 performs density-light quantity conversion on the first density data averaged by the averaging processor 86 (step S109). Further, the inclination corrector 88 performs inclination correction on the density-light quantity converted data (step S110), and the synchronization processor 89 links and synchronizes the first light quantity correction data before synchronization processing, sent from the inclination corrector 88, to the first phase difference read from the phase difference recording part 83 (step S111), and outputs the result of processing as the first light quantity correction data LC1. Then the first light quantity correction data LC1 is stored into the light quantity correction data storage part 90 (step S112).

Next, the data sampling part 85 samples the second density data for plural rotations of the developing sleeve 14*c* by each second period T2 from the input density data (step S113). Then the averaging processor 86 averages the plural second density data pieces by the same portion on the developing sleeve 14*c* (step S114). Then the density-light quantity converter 87 performs density-light quantity conversion on the second density data averaged by the averaging processor 86 (step S115). Further, the inclination corrector 88 performs inclination correction on the density-light quantity converted data (step S116), and the synchronization processor 89 links and synchronizes the second light quantity correction data before synchronization processing, sent from the inclination corrector 88, to the second phase difference read from the phase difference recording part 83 (step S117), and outputs the result of processing as the second light quantity correction data LC2. Then the second light quantity correction data LC2 is stored into the light quantity correction data storage part 90 (step S118).

Thus, the first light quantity correction data LC1 to correct the non-uniformity in density in the slow-scanning direction due to the photoconductor drum 11 and the second light quantity correction data LC2 to correct the non-uniformity in density in the slow-scanning direction due to the developing sleeve 14*c* are obtained as described above. Note that in this description, the first light quantity correction data LC1 is obtained and then the second light quantity correction data LC2 is obtained, however, the second light quantity correction data LC2 may be obtained first.

Figure 7:
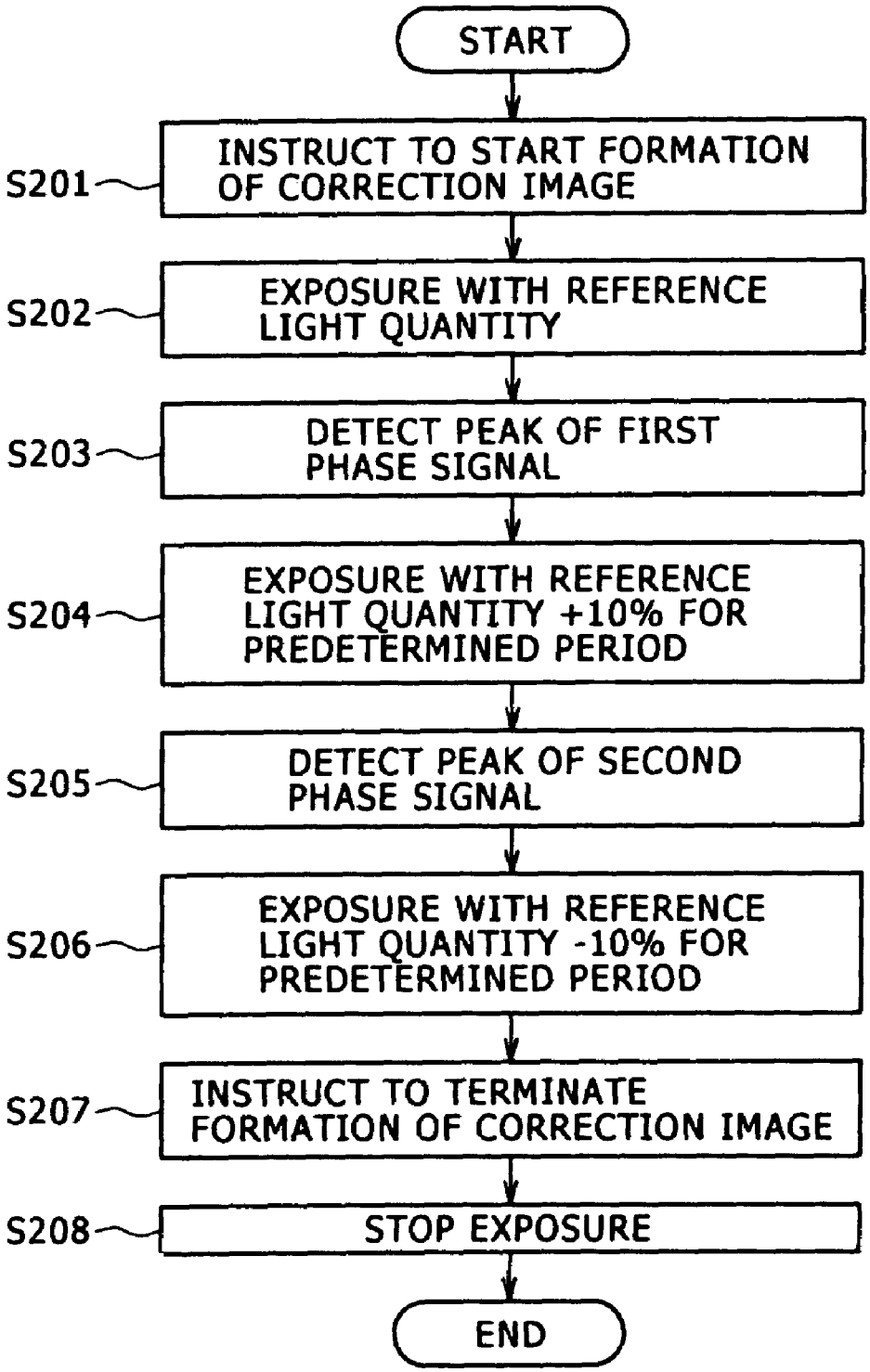
FIG. 7 is a flowchart showing a process of forming a correction image.
Figure 8:
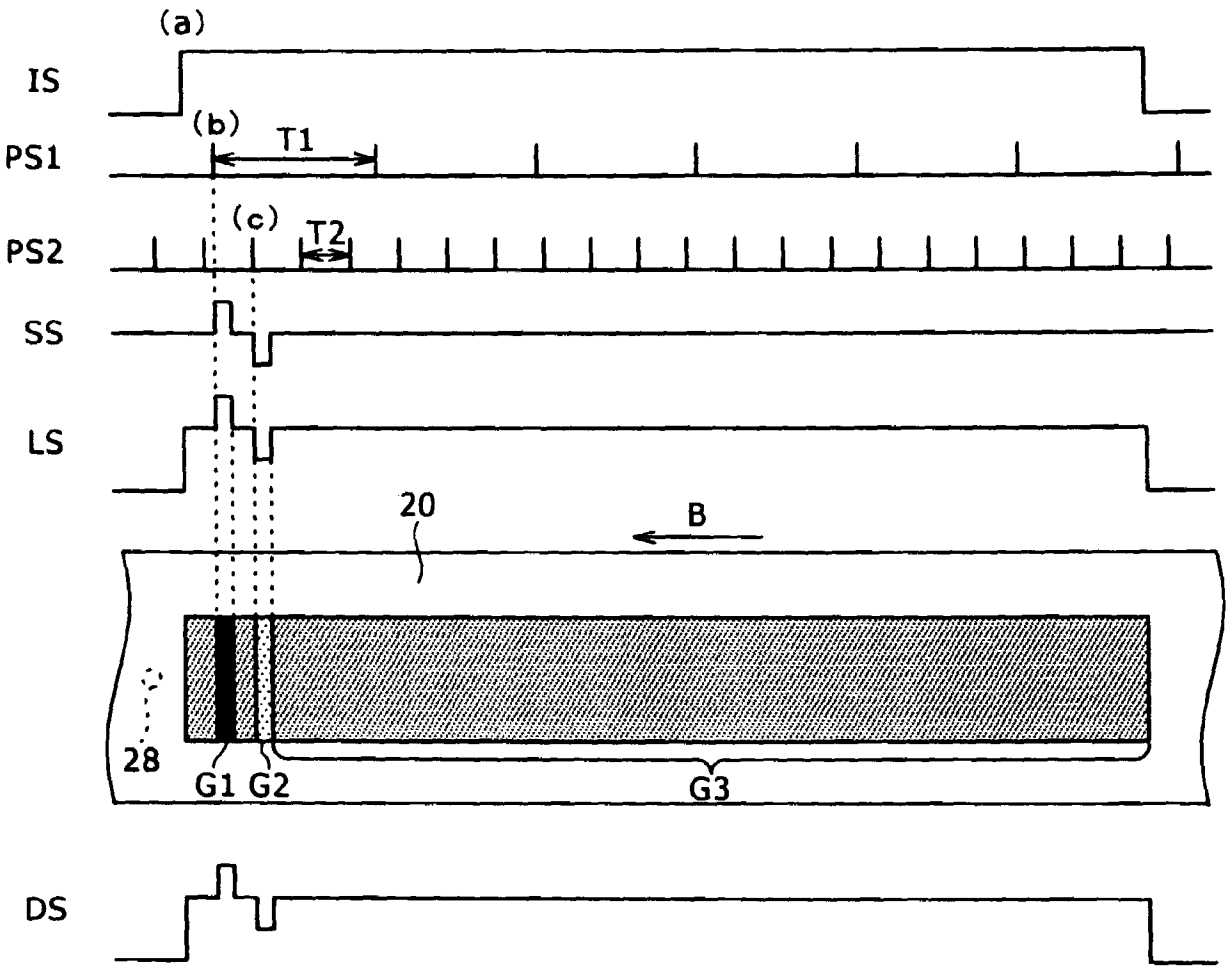
FIG. 8 is a timing chart for explaining the process of forming a correction image.

Next, the formation of the correction image at step S101 in the above processing will be described in detail. FIG. 7 is a flowchart showing a process of forming the correction image. FIG. 8 is a timing chart for explaining the process of forming the correction image.

When the formation of the correction image has been instructed from the main body controller (not shown)(step S201), the IPS 60 outputs the image signal IS corresponding to a reference light quantity to form an electrostatic latent image corresponding to a predetermined density (e.g., 50%) to the exposure part 13 (laser driver 109)(see (a) in FIG. 8). Further, when the formation of the correction image has been instructed, the instruction signal HG is inputted from the main body controller (not shown) into the density corrector 70. Note that at this stage, the light quantity setting signal SS has not been generated in the density corrector 70, and only the image signal IS is inputted into the exposure part 13. The exposure part 13 generates the laser driving signal LS corresponding to the reference light quantity and supplies the signal to the light source 101, to perform exposure on the photoconductor drum 11 (step S202).

After the start of exposure by the exposure part 13, when the first mark M1 is detected by the first phase sensor 17 thereby the peak of the first phase signal PS1 is detected (step S203, see (b) in FIG. 8), then, in response to the detection, the light quantity change part 96 of the light quantity setting part 72 generates the light quantity setting signal SS (referred to as "first mark data") corresponding to the reference light quantity +10% for a predetermined period, and outputs the signal to the exposure part 13. The exposure part 13 generates the laser driving signal LS reflecting the light quantity setting signal SS in the image signal IS, and supplies the laser driving signal LS to the light source 101. As a result, the exposure part 13 exposes the photoconductor drum 11 with the reference light quantity +10% (corresponding to density of e.g. 60%) for a predetermined period (step S204). Note that the exposure part 13 performs exposure with the reference light quantity +10% for the predetermined period, then performs exposure with the reference light quantity again.

Next, when the second mark M2 is detected by the second phase sensor 18 thereby the peak of the second phase signal PS2 is detected (step S205, see (c) in FIG. 8), then, in response to the detection, the light quantity change part 96 of the light quantity setting part 72 generates the light quantity setting signal SS (referred to as "second mark data") corresponding to the reference light quantity −10% for a predetermined period, and outputs the signal to the exposure part 13. The exposure part 13 generates the laser driving signal LS reflecting the light quantity setting signal SS in the image signal IS, and supplies the laser driving signal LS to the light source 101. As a result, the exposure part 13 exposes the photoconductor drum 11 with the reference light quantity −10% (corresponding to density of e.g. 40%) for a predetermined period (step S206). Note that the exposure part 13 performs exposure with the reference light quantity −10% for the predetermined period, then performs exposure with the reference light quantity again. Thereafter, an instruction to terminate the formation of the correction image is made from the main body controller (not shown)(step S207). In accordance with the instruction, the IPS 60 stops output of the image signal IS, and in accordance with the stoppage of the output, the exposure of the photoconductor drum 11 by the exposure part 13 is stopped (step S208), the formation of the correction image is terminated.

The electrostatic latent image formed on the photoconductor drum 11 is developed with toner, then first-transferred onto the intermediate transfer belt 20. Then, as shown in FIG. 8, a correction image G on the intermediate transfer belt 20 includes a first image (mark image) G1 having a high density corresponding to the laser driving signal LS with the reference light quantity +10%, a second image (mark image) G2 having a low density corresponding to the laser driving signal LS with the reference light quantity −10%, and a third image (correction image) G3 having an intermediate density corresponding to the laser driving signal LS with the reference light quantity.

Then, the correction image G sequentially passes through a portion opposite to the density sensor 28 in accordance with the movement of the intermediate transfer belt 20 in an arrow B direction, and read by the density sensor 28. Note that in FIG. 8, a reading area by the density sensor 28 is indicated with a broken line.

Further, FIG. 8 also shows the density detection signal DS obtained by the density sensor 28 at step S102. The density sensor 28 outputs the density detection signal DS obtained by reading the correction image G. When the density sensor 28 reads the first image G1, the density sensor 28 outputs the density detection signal DS at a higher level than the third image G3. When the density sensor 28 reads the second image G2, the density sensor 28 outputs the density detection signal DS at a lower level than the third image G3. Note that in FIG. 8, upon reading of the third image G3, the density detection signal DS which is approximately constant is outputted, however, it is described from a macroscopic viewpoint. From a microscopic viewpoint, slight non-uniformity in density due to the photoconductor drum 11, the developing sleeve 14*c* and the like exists as shown in (a) in FIG. 9.

Figure 9:
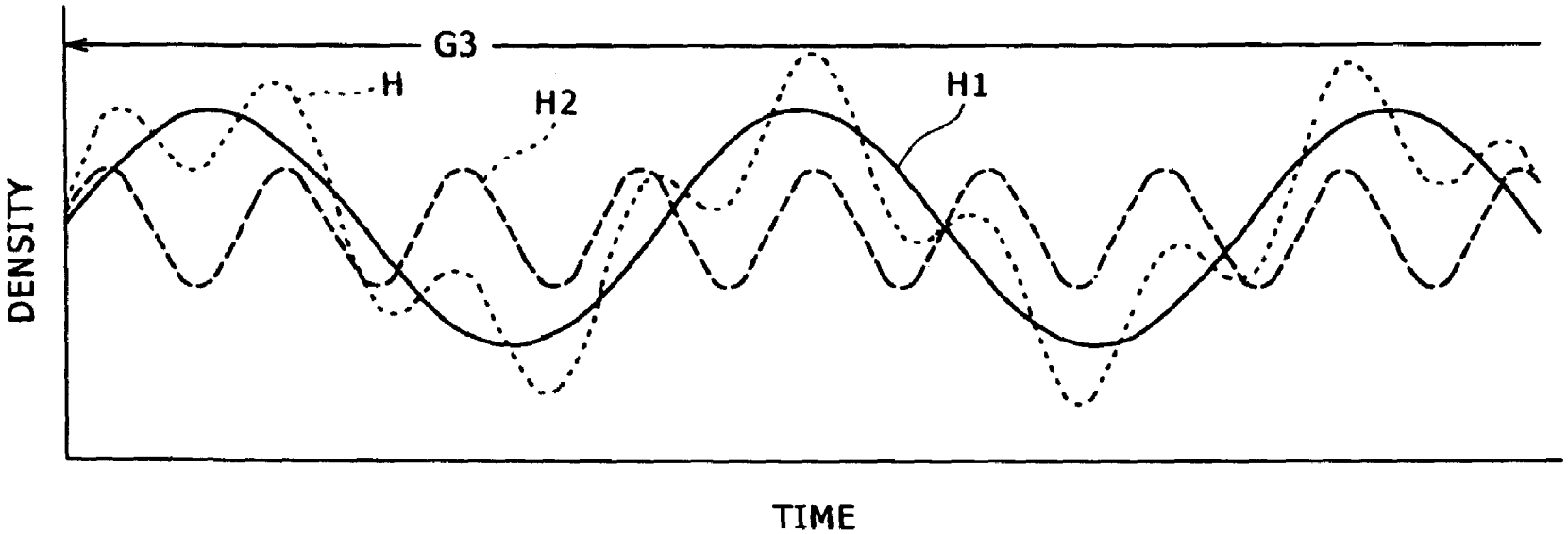
FIG. 9 is a partial enlarged view of density data stored in a density data storage part.

FIG. 9 is a partial enlarged view of density data H obtained by reading the third image G3 shown in FIG. 8 and stored in the density data storage part 81 at the above-described step S103. Note that in FIG. 9, the horizontal axis indicates time, and the vertical axis indicates density. As shown in FIG. 9, even the third image G3, having the initial density (50%), actually has increase and decrease in density from 50%, i.e., non-uniformity in density. In this example, a description will be made on the assumption that the non-uniformity in density in the density data H occurs due to an overlap between a periodic non-uniformity H1 of the photoconductor drum 11 and a periodic non-uniformity H2 of the developing sleeve 14*c* as shown in FIG. 9.

Figure 10:
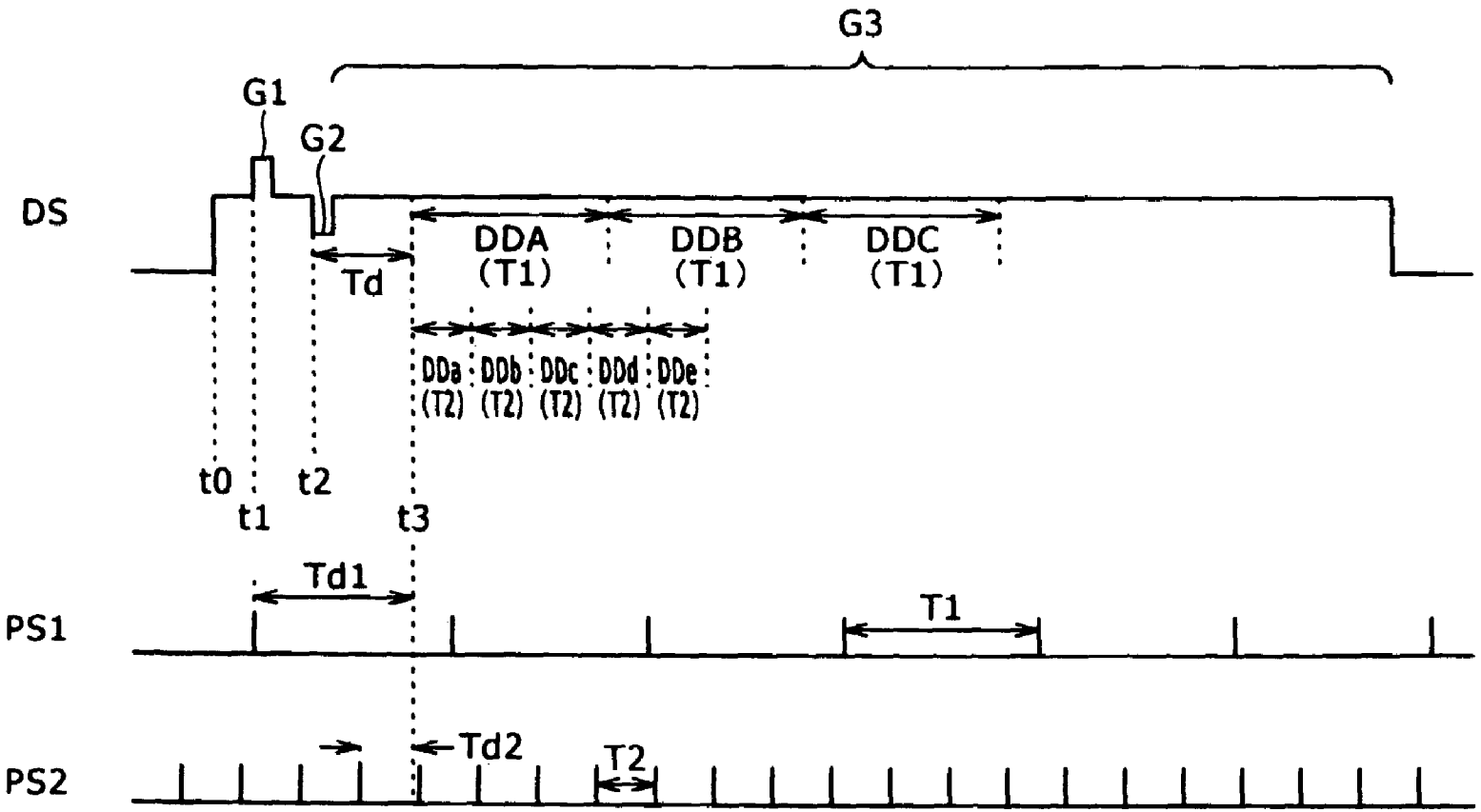
FIG. 10 is an explanatory view of the details of the process of obtaining light quantity correction data.

FIG. 10 is an explanatory view of the processing at the above-described steps S104 to S107 and at step S112. FIG. 10 shows the density data read from the density data storage part 81 (density detection signal DS), the first phase signal PS1 detected by the first phase sensor 17, and the second phase signal PS2 detected by the second phase sensor 18.

First, at step S104, the data processing start point setting part 82 performs setting of the data processing start point as follows. In this description, the detection of the density detection signal DS is started at time to (referred to as "detection start time"), the reading of the first image G1 is started at time t1 (referred to as "first image reading start time"), and the reading of the second image G2 is started at time t2 (referred to as "second image reading start time"). The data processing start point setting part 82 holds previously set delay time Td. The delay time Td is elapsed time from the second image reading start time t2, and is determined such that the third image G3 may be formed with constant density during this time. Then the data processing start point setting part 82 sets time t3, which corresponds with the delay time Td from the second image reading start time t2, as a data processing start point.

Further, at the above-described step S106, the phase difference recording part 83 calculates the first phase difference and the second phase difference as follows. The phase difference recording part 83 calculates time difference (phase difference) between the timing of detection of the peak of the first phase signal PS1 obtained at the above-described step S105 (timing of reading of first mark M1) and the data processing start point t3 set by the data processing start point setting part 82, and records the result of calculation as a first phase difference Td1. Further, the phase difference recording part 83 calculates time difference (phase difference) between the timing of detection of the peak of the second phase signal PS2 obtained at the above-described step S105 (timing of reading of first mark M2) and the data processing start point t3 set by the data processing start point setting part 82, and records the result of calculation as a second phase difference Td2.

Then at the above-described step S107, the data sampling part 85 samples first density data DDA, DDB and DDC for three periods of the first period T1 of the photoconductor drum 11, with the data processing start point t3 as a base point. On the other hand, at the above-described step S112, the data sampling part 85 samples second density data DDa, DDb and DDc, DDd and DDe for five periods of the second period T2 of the developing sleeve 14*c*, with the data processing start point t3 as a base point.

Figure 11A:
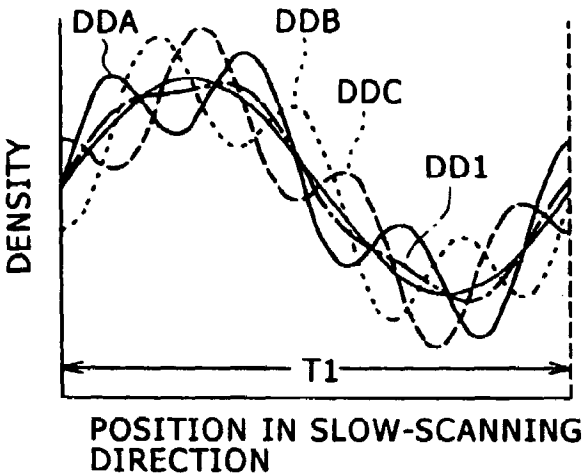
FIG. 11A illustrates first density data obtained by sampling density data by first period and the averaged first density data.

FIG. 11A illustrates the plural first density data pieces DDA to DDC sampled by first period T1 by the data sampling part 85 at the above-described step S107. In FIG. 11A, the horizontal axis indicates the position of the photoconductor drum 11 in the slow-scanning direction, and the vertical axis indicates density. In the present exemplary embodiment, upon data sampling by the data sampling part 85, sampling is performed by 1 line in the fast-scanning direction. In this example, the first density data DDA, DDB and DDC in this order are sampled as shown in FIG. 10. Accordingly, the value of the end of the data DDA and that of the head of the data DDB are continuous.

Further, FIG. 11A also shows the first density data DD1 averaged at the above-described step S108. In this manner, the plural first density data pieces DDA to DDC are averaged by the same portion, thereby the influence of non-uniformity in density due to the developing sleeve 14*c* side can be reduced. That is, the non-uniformity in density can be close to that due to the photoconductor drum 11 side (indicated with a solid line in the figure). When the number of samples of the first density data to be averaged is further increased, the averaged first density data DD1 can be closer to the true value. However, for this purpose, it is necessary to form the third image G3 longer in correspondence with the increased number of samples. Accordingly, in this example, the data is sampled for three periods.

Figure 11B:
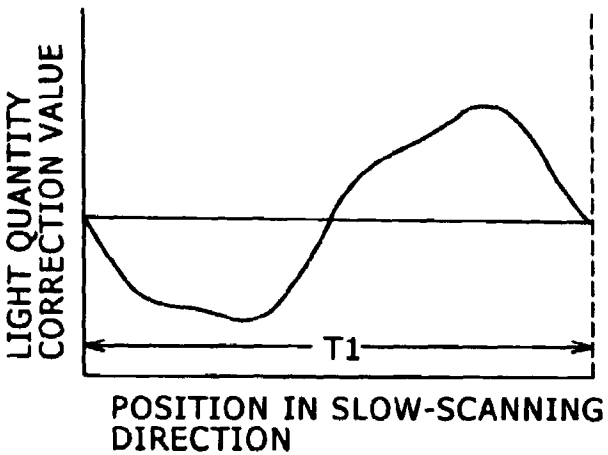
FIG. 11B illustrates first light quantity correction data before inclination correction.

FIG. 11B illustrates the result of density-light quantity conversion on the first density data DD1 averaged at the above-described step S109, i.e., the first light quantity correction data before inclination correction. In FIG. 11B, the horizontal axis indicates the position of the photoconductor drum 11 in the slow-scanning direction, and the vertical axis, a light quantity correction value. In the present exemplary embodiment, a portion of the charged photoconductor drum 11 where a toner image is formed is exposed by the exposure part 13. Accordingly, to adjust the density of the formed toner image, it is necessary upon formation of the third image G3 to reduce the amount of exposure so as to reduce the density regarding a high density portion, and necessary to increase the amount of exposure so as to increase the density regarding a low density portion.

Figure 11C:
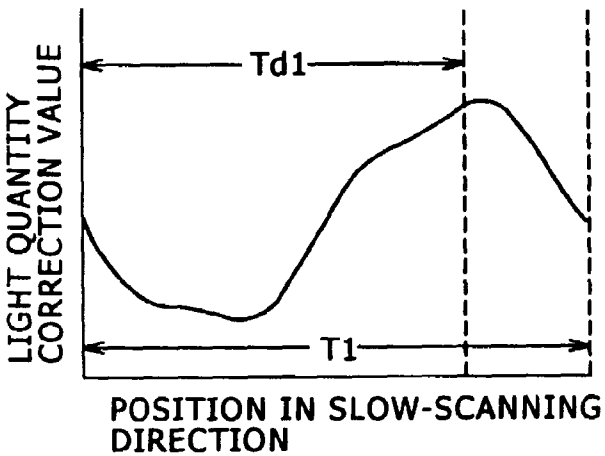
FIG. 11C illustrates first light quantity correction data before synchronizing processing.

FIG. 11C illustrates the first light quantity correction data before synchronizing processing, inclination-corrected at the above-described step S110. In FIG. 11C, the horizontal axis indicates the position of the photoconductor drum 11 in the slow-scanning direction, and the vertical axis, a light quantity correction value. The inclination corrector 88 obtains an inclination from the difference between the head value and the end value of the first light quantity correction data before inclination correction, and performs inclination correction so as to bring the head value and the end value into correspondence. In this example, since there is almost no difference between the head value and the end value of the first light quantity correction data before inclination correction, the obtained light quantity correction data has approximately the same as the first light quantity correction data before inclination correction.

Figure 11D:
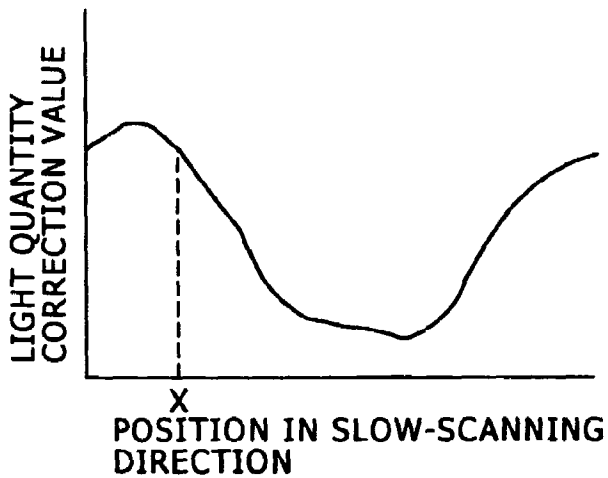
FIG. 11D illustrates first light quantity correction data after synchronizing processing.

Further, FIG. 11C also shows the first phase difference Td1 used in the synchronization processing at the above-described step S111. The synchronization processor 89 links and synchronizes the first light quantity correction data before synchronization processing, inputted from the inclination corrector 88, to the first phase difference Td1 read from the phase difference recording part 83. In this example, the synchronization processor 89 shifts the origin point of the data by the first phase difference Td1 in the first period T1. Accordingly, the obtained origin point corresponds to the position on the photoconductor drum 11 where the first mark M1 is formed. FIG. 11D shows the first light quantity correction data LC1 stored into the light quantity correction data storage part 90 in the state where the origin point is shifted by this synchronization processing.

Figure 12A:
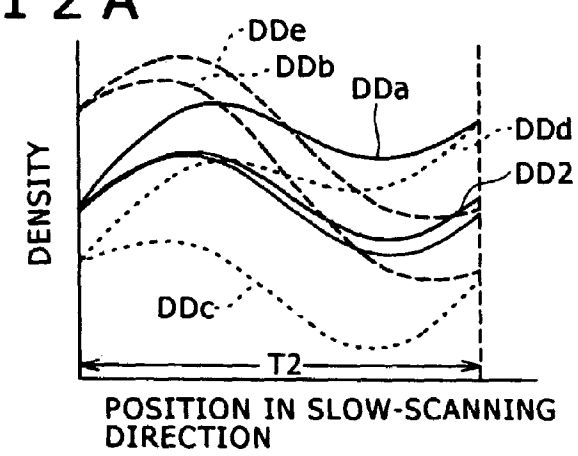
FIG. 12A illustrates second density data obtained by sampling density data by second period and the averaged second density data.

Further, FIG. 12A illustrates the plural second density data pieces DDa to DDe sampled by the second period T2 by the data sampling part 85 at the above-described step S113. In FIG. 12A, the horizontal axis indicates the position of the developing sleeve 14*c* in the slow-scanning direction, and the vertical axis, density. As described above, in the present exemplary embodiment, sampling is performed by one line in the fast-scanning direction. In this example, the second density data DDa, DDb, DDc, DDd and DDe, in this order, are sampled as shown in FIG. 10. Accordingly, the end value of the data DDa and the head value of the data DDb are continuous.

Further, FIG. 12A also shows the second density data DD2 averaged at the above-described step S114. In this manner, the plural second density data pieces DDa to DDe are averaged by the same portion, thereby the influence of non-uniformity in density due to the photoconductor drum 11 side can be reduced. That is, the non-uniformity in density can be close to that due to the developing sleeve 14*c* side (indicated with a solid line in the figure). In this example, as the second period T2 of the developing sleeve 14*c* is shorter than the first period T1 of the photoconductor drum 11, the number of samples of the second density data is larger than that of the first density data, i.e., for five periods.

Figure 12C:
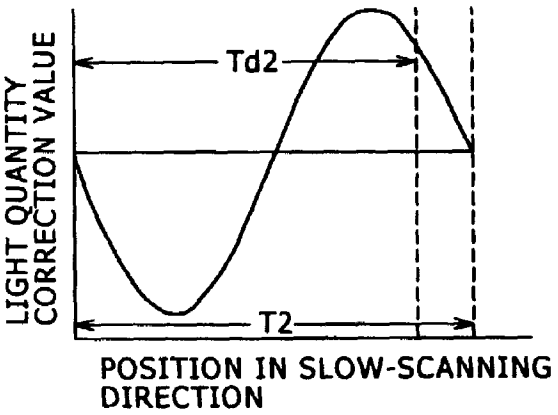
FIG. 12C illustrates second light quantity correction data before synchronizing processing.
Figure 12B:
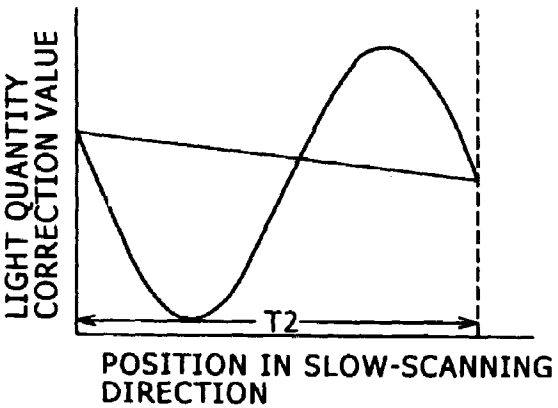
FIG. 12B illustrates second light quantity correction data before inclination correction.

FIG. 12B illustrates the result of density-light quantity conversion on the second density data DD2 (see (a) in FIG. 10) at the above-described step S115, i.e., the second light quantity correction data before inclination correction. In FIG. 12B, the horizontal axis indicates the position of the developing sleeve 14*c* in the slow-scanning direction, and the vertical axis, a light quantity correction value.

FIG. 12C illustrates the second light quantity correction data before synchronizing processing, inclination-corrected at the above-described step S116. In FIG. 12C, the horizontal axis indicates the position of the developing sleeve 14*c* in the slow-scanning direction, and the vertical axis, a light quantity correction value. The inclination corrector 88 obtains an inclination from the difference between the head value and the end value of the second light quantity correction data before inclination correction, and performs inclination correction so as to bring the head value and the end value into correspondence. In this example, since the influence of non-uniformity in density due to the photoconductor drum 11 side remains in the second light quantity correction data before inclination correction, there is a wide difference between the head value and the end value of the second light quantity correction data before inclination correction. Accordingly, inclination correction to increase the value on the end side is performed. Thus, the continuity between the head value and the end value of the second light quantity correction data before synchronization processing can be ensured.

Figure 12D:
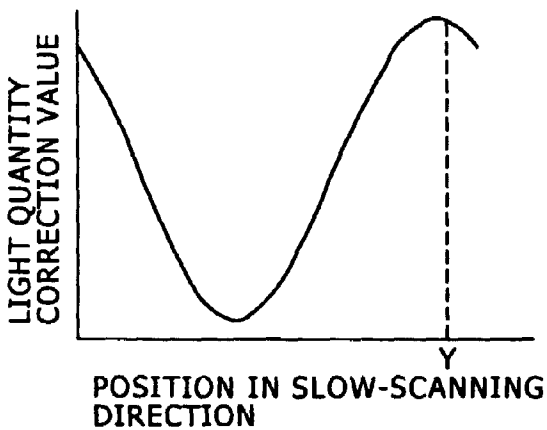
FIG. 12D illustrates second light quantity correction data after synchronizing processing.

Further, FIG. 12C also shows the second phase difference Td2 used in the synchronization processing at the above-described step S117. The synchronization processor 89 links and synchronizes the second light quantity correction data before synchronization processing, inputted from the inclination corrector 88, to the second phase difference Td2 read from the phase difference recording part 83. In this example, the synchronization processor 89 shifts the origin point of the data by the second phase difference Td2 in the second period T2. Accordingly, the obtained origin point corresponds to the position on the developing sleeve 14*c* where the second mark M2 is formed. FIG. 12D shows the second light quantity correction data LC2 stored into the light quantity correction data storage part 90 in the state where the origin point is shifted by this synchronization processing.

Figure 13:
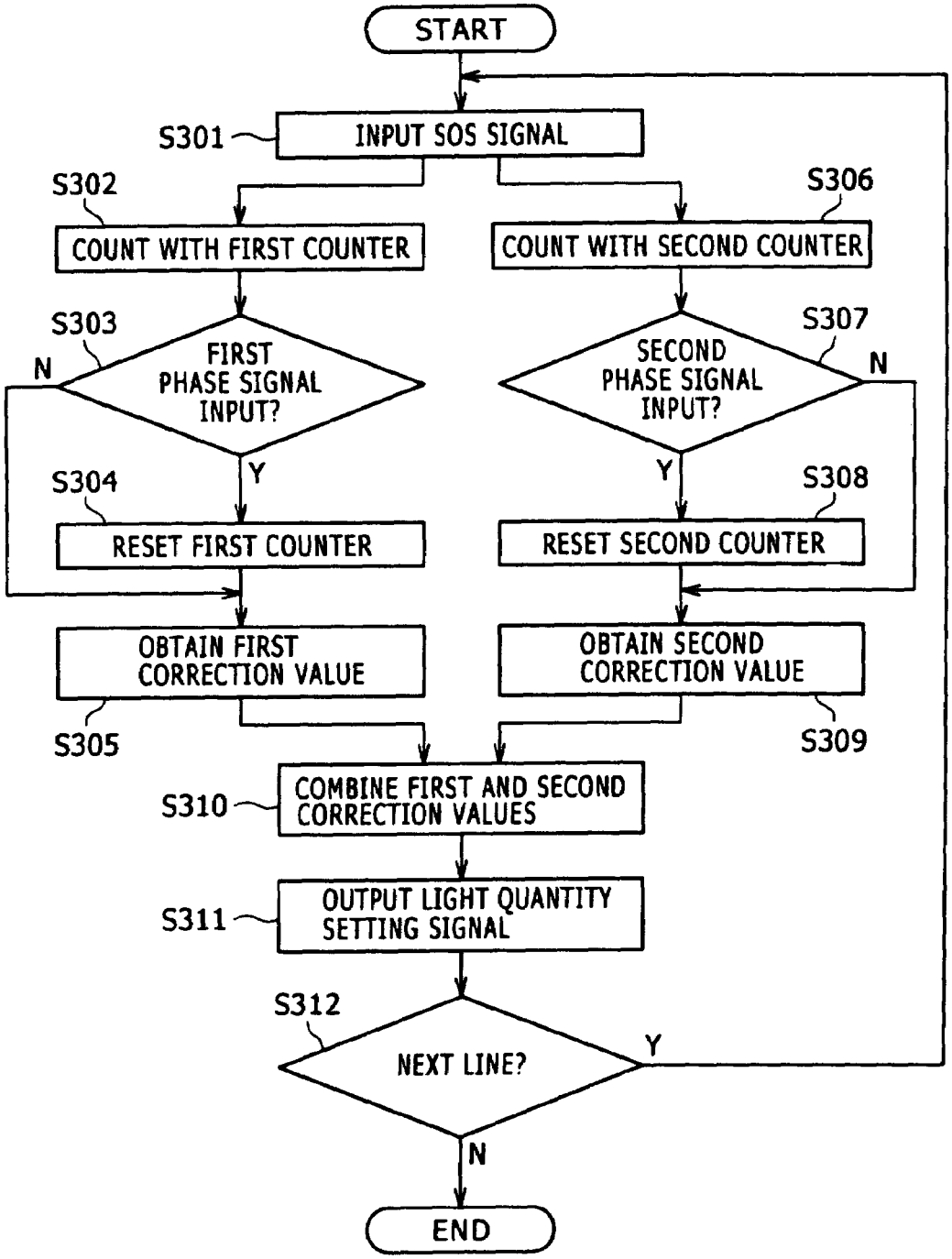
FIG. 13 is a flowchart showing a process of setting a light quantity setting signal by the light quantity setting part.

Next, the light quantity correction of the laser beam L, performed upon image forming operation, using the first light quantity correction data LC1 and the second light quantity correction data LC2 obtained as above, will be described. FIG. 13 is a flowchart showing a process of setting the light quantity setting signal by the above-described light quantity setting part 72.

When emission of the laser beam L is started in accordance with the start of image forming operation, the SOS signal generated in accordance with the start of laser beam emission is inputted into the light quantity setting part 72 (step S301).

Then, in the first counter 91, the first count value is incremented by "1" in response to the input of the SOS signal (step S302). Next, in the first counter 91, it is determined whether or not the first phase signal PS1 has been inputted (step S303), and when it is determined that the first phase signal PS1 has been inputted, the first count value of the first counter 91 is reset (step S304). On the other hand, when it is determined that the first phase signal PS1 has not been inputted, the process proceeds to step S305. Then, the first corrector 92 refers to the first light quantity correction data LC1 read from the light quantity correction data storage part 90 of the correction setting part 71, and obtains a first correction value corresponding to the first count value inputted from the first counter 91 (step S305).

On the other hand, in parallel with the above-described steps S302 to S305, in the second counter 93, the second count value is incremented by "1" in response to the input of the SOS signal (step S306). Next, in the second counter 93, it is determined whether or not the second phase signal PS2 has been inputted (step S307), and when it is determined that the second phase signal PS2 has been inputted, the second count value of the second counter 93 is reset (step S308). On the other hand, when it is determined that the second phase signal PS2 has not been inputted, the process proceeds to step S309. Then, the second corrector 94 refers to the second light quantity correction data LC2 read from the light quantity correction data storage part 90 of the correction setting part 71, and obtains the second correction value corresponding to the second count value inputted from the second counter 93 (step S309).

Thereafter, the combining part 95 adds the first correction value obtained at step S305 to the second correction value obtained at step S309 (step S310), and outputs the result of addition as the light quantity setting signal SS to the exposure part 13 (step S311). Then, it is determined whether or not the next line (in the next fast-scanning direction) exists (step S312). When it is determined that the next line exists, the process returns to step S301 to continue the processing. On the other hand, when it is determined that the next line does not exist, the process ends.

At the above-described step S305, the first correction value is obtained, for example, as follows. The first corrector 92 determines a position X on the photoconductor drum 11 in the slow-scanning direction arriving at an exposure position (an opposing position between the exposure part 13 and the photoconductor drum 11) based on the obtained first count value. Next, the first corrector 92 obtains the light quantity correction value corresponding to the determined position X in the slow-scanning direction from the first light quantity correction data LC1 shown in FIG. 11D, and outputs the value as the first correction value.

On the other hand, at the above-described step S309, the second correction value is obtained, for example, as follows. The second corrector 94 determines a position Y on the developing sleeve 14*c* in the slow-scanning direction when the position X on the photoconductor drum 11 in the slow-scanning direction arrives at the exposure position (the opposing position between the photoconductor drum 11 and the developing sleeve 14*c*) based on the obtained second count value. Next, the second corrector 94 obtains the light quantity correction value corresponding to the determined position Y in the slow-scanning position from the second light quantity correction data LC2 shown in FIG. 12D, and outputs the value as the second correction value.

Then, the combining part 95 adds the first correction value corresponding to the position X on the photoconductor drum 11 in the slow-scanning direction passing through the exposure position to the second correction value corresponding to the position Y on the developing sleeve 14*c* in the slow-scanning direction opposing the position X when the position X on the photoconductor drum 11 in the slow-scanning direction passes, as the light quantity setting signal SS. That is, the light quantity setting signal SS is calculated by 1 line in correspondence with the same line in the fast-scanning direction, and outputted.

Figure 14:
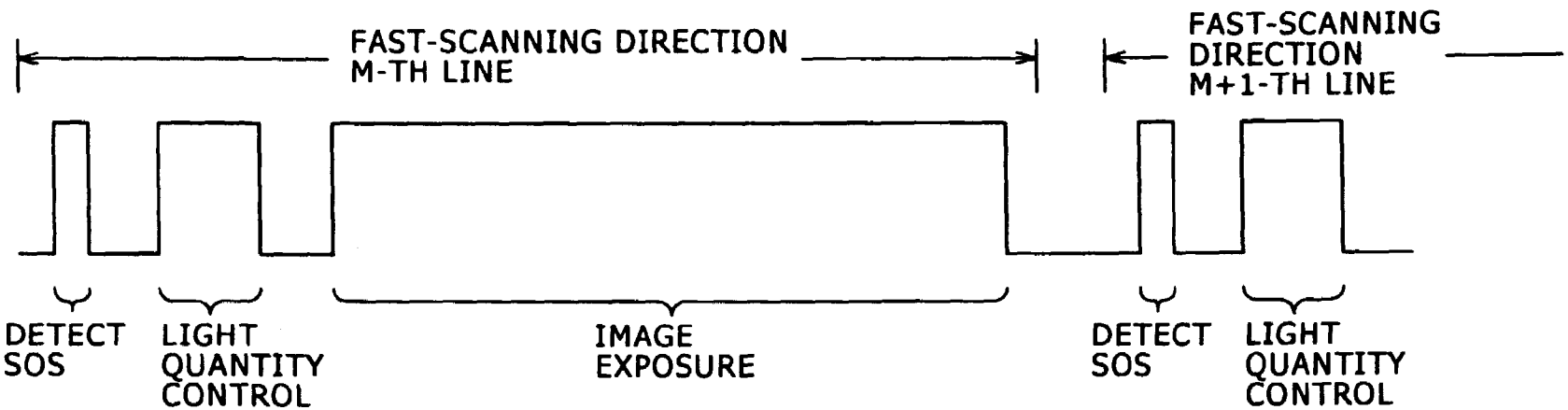
FIG. 14 is a timing chart for explaining driving of a light source (semiconductor laser) by a laser driver.

FIG. 14 is a timing chart for explaining driving of the light source (semiconductor laser) 101 by the laser driver 109 shown in FIG. 2. Note that FIG. 14 shows m-th line and m+1-th line in the fast-scanning direction.

The laser driver 109 sequentially outputs a driving signal for SOS detection, a driving signal for light quantity control, and a driving signal for image exposure, by one line in the fast-scanning direction. Then, the laser beam L is emitted from the light source 101 in accordance with the output of the driving signal for SOS detection, and the laser beam L is detected by the SOS sensor 108, thereby the SOS signal is outputted. The SOS signal is inputted via the laser driver 109 into the light quantity setting part 72 of the density corrector 70, and subjected to the processing shown in FIG. 13 in the light quantity setting part 72, thereby the light quantity setting signal SS is generated. Next, the generated light quantity setting signal SS is inputted into the laser driver 109 of the exposure part 13. The laser driver 109 outputs the driving signal for light quantity control, output-controlled in correspondence with the received light quantity setting signal SS, and the light-quantity controlled laser beam L is outputted from the light source 101. Thereafter, the laser driver 109 outputs the laser driving signal LS for image exposure, while performing light quantity control on the input image signal IS with the light quantity setting signal SS. Then the image forming area on the photoconductor drum 11 is scan-exposed with the light-quantity controlled laser beam L from the light source 101, thereby an electrostatic latent image is formed.

In this manner, in the present exemplary embodiment, to correct the periodic non-uniformity in density of the photoconductor drum 11 and the developing sleeve 14*c*, the first light quantity correction data LC1 and the second light quantity correction data LC2 are previously obtained. Then, upon actual image formation, the light quantity setting signal SS is generated by combining the first correction value and the second correction value corresponding to the same line in the fast-scanning direction obtained from these the first light quantity correction data LC1 and the second light quantity correction data LC2, and light quantity correction is performed in the exposure part 13 using the light quantity setting signal SS. In this arrangement, the non-uniformity in density occurred in synchronization with the first period T1 as a rotation period of the photoconductor drum 11 and the non-uniformity in density occurred in synchronization with the second period T2 as a rotation period of the developing sleeve 14*c* can be suppressed by exposure amount control by the exposure part 13.

In the present exemplary embodiment, the first mark M1 is provided on the photoconductor drum 11, and the first mark M1 is read by the first phase sensor 17, thereby the phase of the photoconductor drum 11 is detected. Then, upon formation of the correction image for obtaining the first light quantity correction data LC1, the high-density first image G1 is formed in the correction image based on the result of detection of the first mark M1 by the first phase sensor 17. In this arrangement, the position on the photoconductor drum 11 in the slow-scanning direction in the third image G3 in the correction image can be easily obtained. Accordingly, linking (synchronization) between the position on the photoconductor drum 11 in the slow-scanning direction and the first light quantity correction data LC1 can be easily made.

Further, in the present exemplary embodiment, the second mark M2 is provided on the developing sleeve 14*c*, and the second mark M2 is read by the second phase sensor 18, thereby the phase of the developing sleeve 14*c* is detected. Then, upon formation of the correction image for obtaining the second light quantity correction data LC2, the intermediate-density second image G2 is formed in the correction image based on the result of detection of the second mark M2 by the second phase sensor 18. In this arrangement, the position on the developing sleeve 14*c* in the slow-scanning direction in the second image G3 in the correction image can be easily obtained. Accordingly, linking (synchronization) between the position on the developing sleeve 14*c* in the slow-scanning direction and the second light quantity correction data LC2 can be easily made.

Further, in the present exemplary embodiment, as the density of the first image G1 is higher than that of the third image G3, and that of the second image G2 is lower than that of the third image G3, the first image G1 can be easily distinguished from the third image G3. The first light quantity correction data LC1 and the second light quantity correction data LC2 can be obtained based on the same third image G3. Accordingly, the slow-scanning directional length of the correction image can be reduced, and the time from the formation of the correction image to the acquisition of the first light quantity correction data LC1 and the second light quantity correction data LC2 can be reduced.

Note that in the present exemplary embodiment, the density of the first image G1 formed based on the first mark M1 on the photoconductor drum 11 is higher than that of the third image G3 and the density of the second image G2 formed based on the second mark M2 on the developing sleeve 14*c* is lower than that of the third image G3 (see FIG. 8). The third image G3 is formed in correspondence with, e.g., the reference light quantity, the first image G1 is formed in correspondence with, e.g., exposure with the reference light quantity +10%, and the second image G2 is formed in correspondence with, e.g., exposure with the reference light quantity −10%. Then, a density change amount by ±10% light quantity change from the reference light quantity can be obtained based on respective density data obtained by reading the first image G1, the second image G2 and the third image G3. Accordingly, light quantity correction in the exposure 13 can be performed based on the obtained density change amount. In an image forming apparatus using an electrophotographic technology as in the case of the present exemplary embodiment, even if the light quantity is changed by the same amount, the density of actually obtained image is changed in correspondence with the state (temperature, humidity, use period and the like) of the apparatus. Accordingly, the above arrangement enables light quantity correction always corresponding to the apparatus state, and prevents insufficient correction or excessive correction.

Further, in the present exemplary embodiment, the laser driving signal LS to be outputted to the light source 101 of the exposure part 13 is controlled using the obtained light quantity setting signal SS, however, the invention is not limited to this arrangement. For example, as indicated with a broken line in FIG. 3, it may be arranged such that a light quantity setting signal SS' is outputted to the IPS 60. In this case, the image signal IS, subjected to correction of non-uniformity in density in the slow-scanning direction, is inputted from the IPS 60 into the exposure part 13. Further, the non-uniformity in density can be corrected by changing the charging bias supplied to the charging roller 12 or controlling the developing bias supplied to the developing sleeve 14*c*.

Second Exemplary Embodiment

In this exemplary embodiment, the formation of the correction image is started in correspondence with the result of detection of the first mark M1 provided on the photoconductor drum 11 which functions as a submodule, and the formation of the correction image is terminated in correspondence with the result of detection of the second mark M2 provided on the developing sleeve 14*c* which functions as another submodule. Note that the constituent elements corresponding to those in the first exemplary embodiment have the same reference numerals and the detailed explanations thereof will be omitted.

Figure 15:
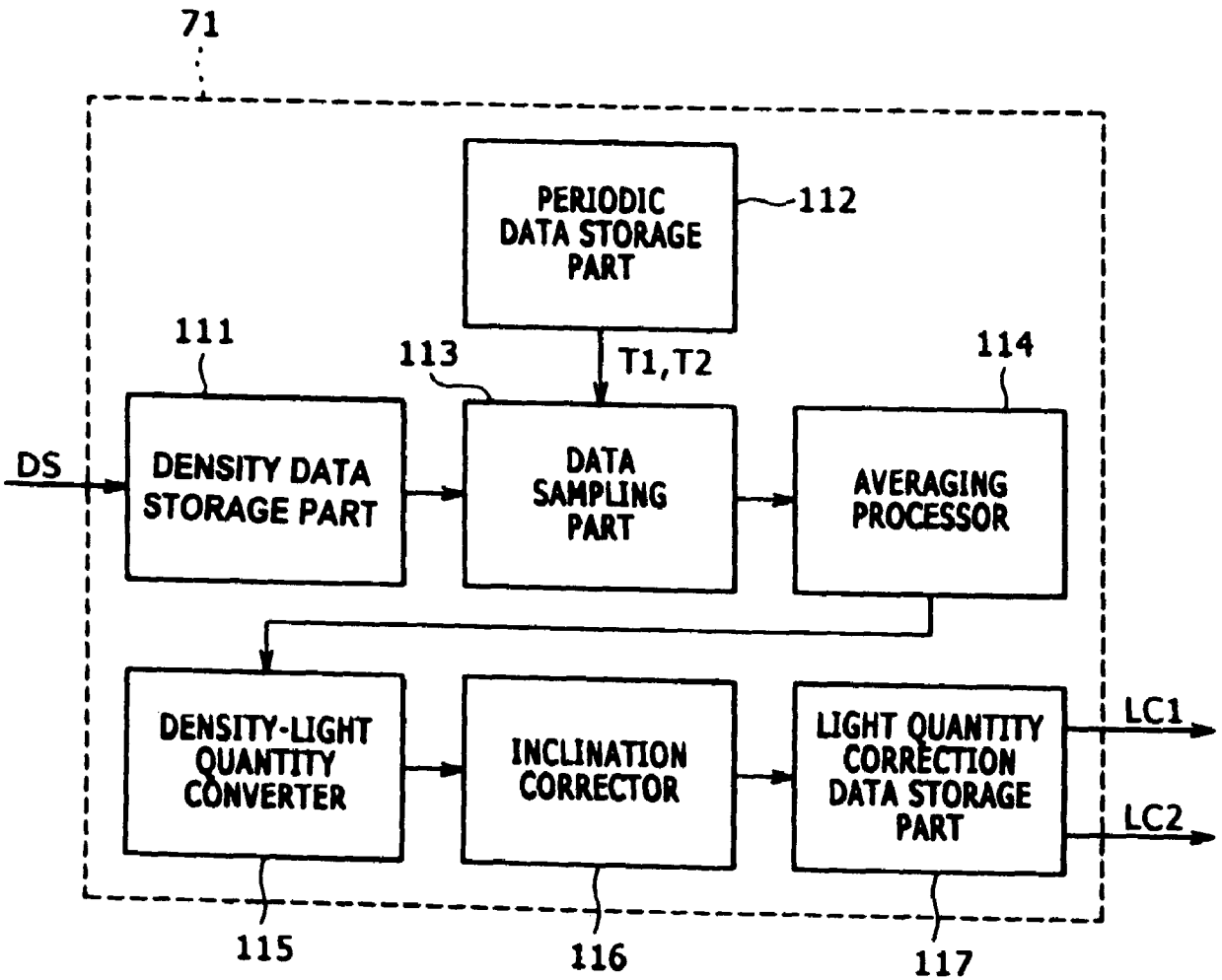
FIG. 15 is a block diagram showing the configuration of the correction setting part used in a second exemplary embodiment.

FIG. 15 is a block diagram showing the configuration of the correction setting part 71 used in the present exemplary embodiment. The correction setting part 71 has a density data storage part 111, a periodic data storage part 112, a data sampling part 113, an averaging processor 114, a density-light quantity converter 115, an inclination corrector 116 and a light quantity correction data storage part 117. These respective function parts correspond to the density data storage part 81, the periodic data storage part 84, the data sampling part 85, the averaging processor 86, the density-light quantity converter 87, the inclination corrector 88 and the light quantity correction data storage part 90 described in the first exemplary embodiment, and have approximately the same functions.

Figure 16:
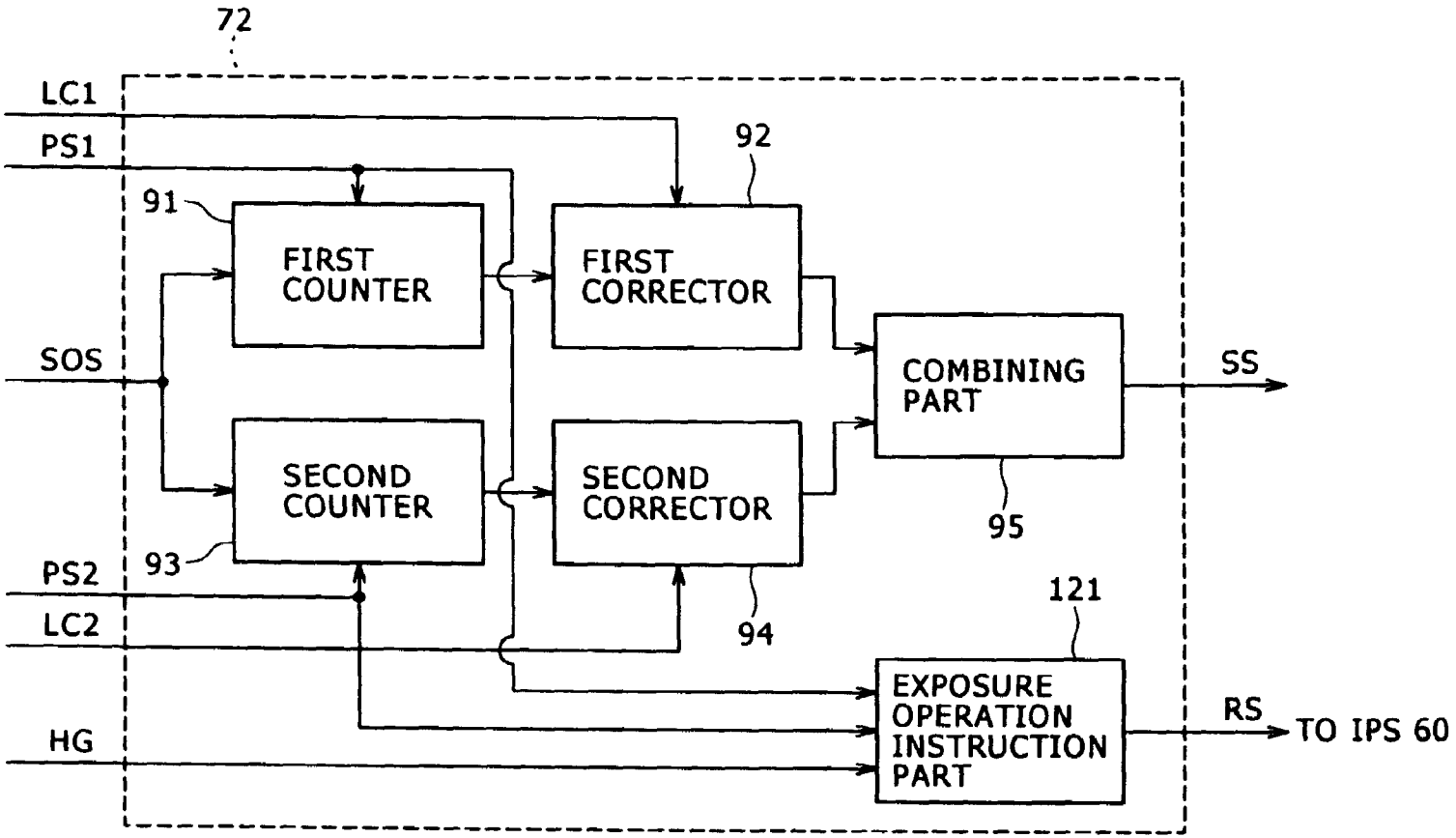
FIG. 16 is a block diagram showing the configuration of the light quantity setting part used in the second exemplary embodiment.

FIG. 16 is a block diagram showing the configuration of the light quantity setting part 72 used in the present exemplary embodiment. The basic configuration of the light quantity setting part 72 is approximately the same as that described in the first exemplary embodiment, and the difference is that an exposure operation instruction part 121 is provided in place of the light quantity change part 96. The instruction signal HG to instruct correction image formation is inputted from the main body controller (not shown) into the exposure operation instruction part 121. Further, the first phase signal PS1 from the first phase sensor 17 and the second phase signal PS2 from the second phase sensor 18 are inputted into the exposure operation instruction part 121. Then, the exposure operation instruction part 121 generates an exposure operation signal RS to instruct start and end of exposure operation based on the instruction signal HG, the first phase signal PS1 and the second phase signal PS2, and outputs the exposure operation signal RS to the IPS 60.

Figure 17:
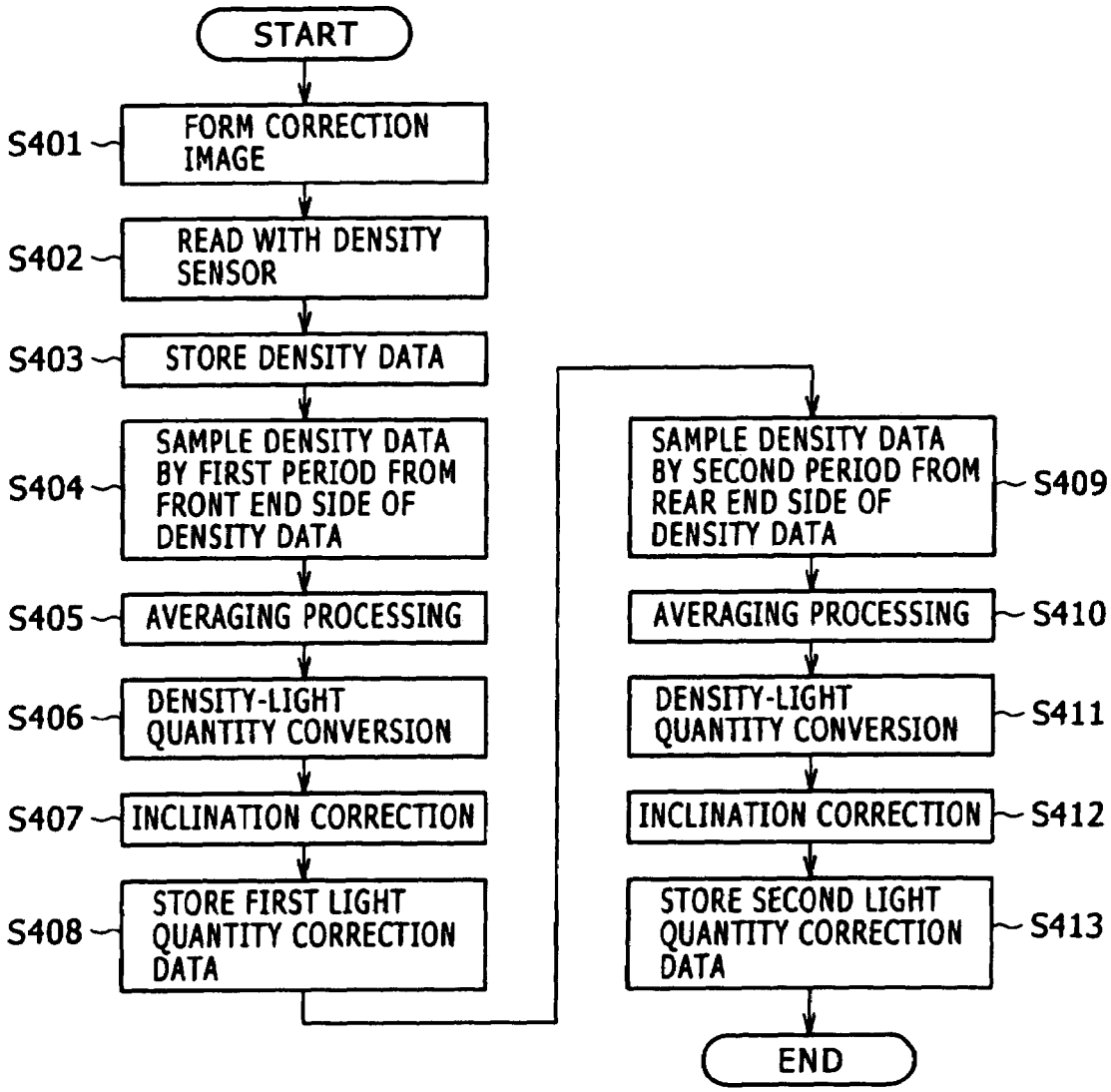
FIG. 17 is a flowchart showing the process of obtaining plural light quantity correction data pieces by the correction setting part according to the second exemplary embodiment.

FIG. 17 is a flowchart showing the process of obtaining the first light quantity correction data LC1 and the second light quantity correction data LC2 by the above-described correction setting part 71.

In this processing, first, the correction image is formed on the intermediate transfer belt 20 using the image forming apparatus (step S401). Note that the details of the correction image formed here will be described later.

Next, the density of the toner image formed on the intermediate transfer belt 20 is read by the density sensor 28 (step S402), and the obtained density detection signal DS is outputted to the correction setting part 71. Then the correction setting part 71 receives the signal, and stores the density detection signal DS, as density data arrayed in the slow-scanning direction, into the density data storage part 111 (step S403).

Then the data sampling part 113 samples the first density data for plural rotations of the photoconductor drum 11 by the first period T1 from the front end side of the density data read from the density data storage part 111 (step S404). Thereafter, the averaging processor 114 averages the plural first density data pieces by the same portion on the photoconductor drum 11 (step S405). Then, the density-light quantity converter 115 performs density-light quantity conversion on the first density data averaged by the averaging processor 114 (step S406). Further, the inclination corrector 116 performs inclination correction on the density-light quantity converted data (step S407), and outputs the result of inclination correction as the first light quantity correction data LC1. Then, the first light quantity correction data LC1 is stored into the light quantity correction data storage part 117 (step S408).

Next, the data sampling part 113 samples the second density data for plural rotations of the developing sleeve 14*c* by the second period T2 from the rear end side of the density data read from the density data storage part 111 (step S409). Thereafter, the averaging processor 114 averages the plural second density data pieces by the same portion on the developing sleeve 14*c* (step S410). Then, the density-light quantity converter 115 performs density-light quantity conversion on the second density data averaged by the averaging processor 114 (step S411). Further, the inclination corrector 116 performs inclination correction on the density-light quantity converted data (step S412), and outputs the result of inclination correction as the second light quantity correction data LC2. Then, the second light quantity correction data LC2 is stored into the light quantity correction data storage part 117 (step S413).

Figure 18:
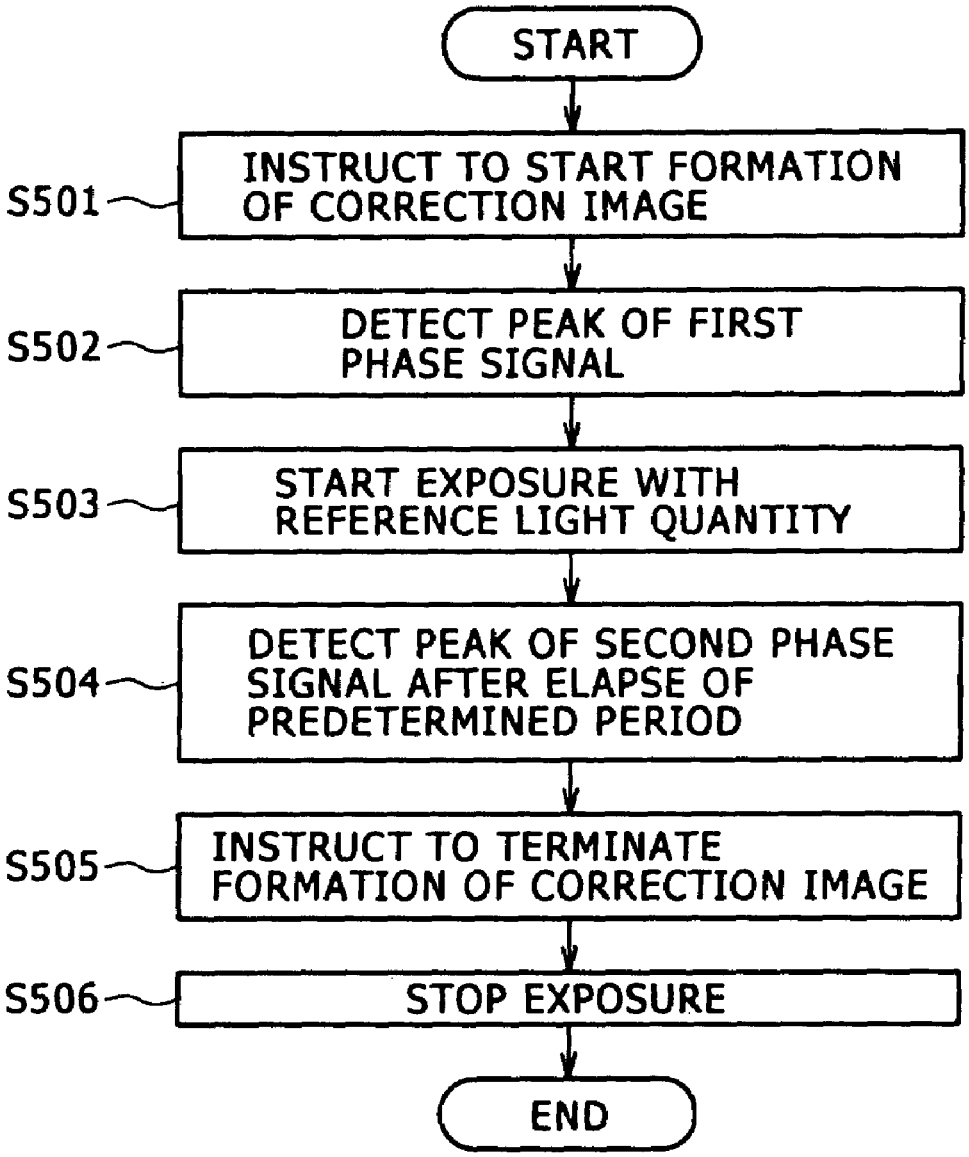
FIG. 18 is a flowchart showing the process of forming a correction image according to the second exemplary embodiment.
Figure 19:
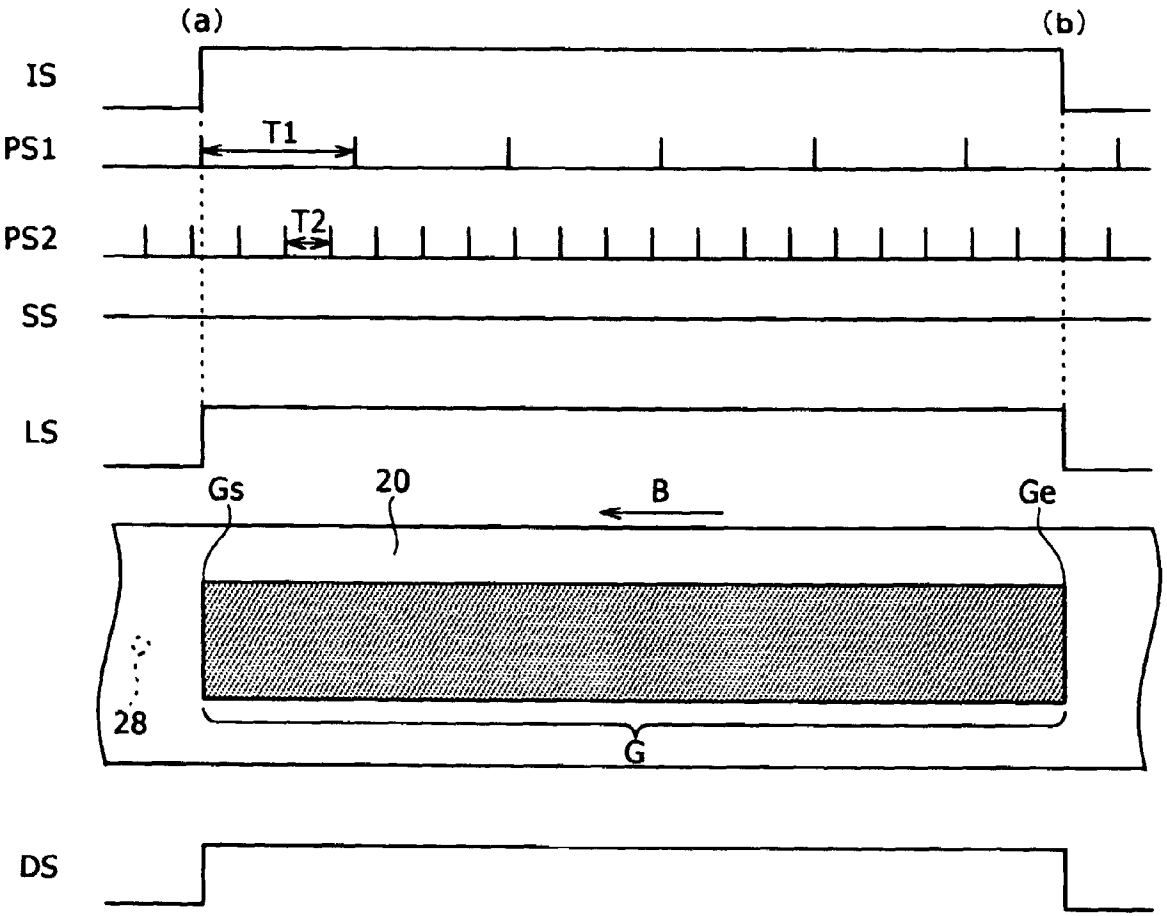
FIG. 19 is a timing chart for explaining the process of generating a correction image according to the second exemplary embodiment.

Next, the details of the formation of the correction image at the above-described step S401 will be described. FIG. 18 is a flowchart showing the process of forming the correction image. FIG. 19 is a timing chart showing timing of the process of forming the correction image.

When the start of formation of the correction image is instructed (step S501) from the main body controller (not shown) and then the first mark M1 is detected by the first phase sensor 17 thereby the peak of the first phase signal PS1 is detected (step S502, see (a) in FIG. 19), in response to the detection of the peak of the first phase signal PS1, the exposure operation instruction part 121 of the light quantity setting part 72 outputs the exposure operation signal RS to the IPS 60. The IPS 60 outputs the image signal IS corresponding to the reference light quantity to the exposure part 13. The exposure part 13 supplies the laser driving signal LS corresponding to the reference light quantity with the laser driver 109 to the light source 101, to perform exposure of the photoconductor drum 11.

Then, the exposure operation instruction part 121 measures the elapsed time from the start of output of the exposure operation signal RS with a timer (not shown). When the measurement time with the timer has become longer than a predetermined period and the second mark M2 has been detected by the second phase sensor 18 thereby the peak of the second phase signal PS2 has been detected (step S504, see (b) in FIG. 19), an instruction to terminate the formation of correction image is made from the main body controller (not shown) (step S505). In response to the instruction, the exposure operation instruction part 121 outputs the exposure operation signal RS to the IPS 60. The IPS 60 stops the output of the image signal IS, and in accordance with the stoppage of signal output, the exposure of the photoconductor drum 11 by the exposure part 13 is stopped (step S506), thus the formation of correction image is terminated.

The electrostatic latent image formed on the photoconductor drum 11 as described above is developed with toner, and first-transferred onto the intermediate transfer belt 20. Then, as shown in FIG. 19, the correction image G on the intermediate transfer belt 20 has basically the same density. Further, the upstream-side end of the correction image G is referred to as a front end Gs, and the downstream-side end of the correction image G is referred to as a rear end Ge.

The correction image G sequentially passes through an opposing portion to the density sensor 28 in accordance with the movement of the intermediate transfer belt 20 in an arrow B direction, and reading by the density sensor 28 is performed.

FIG. 19 also shows the density detection signal DS read by the density sensor 28 at the above-described step S402. In this example, as the correction image G has basically the same density, the outputted density detection signal DS is approximately constant. However, as described in the first exemplary embodiment, the signal actually includes slight non-uniformity in density due to the photoconductor drum 11, the developing sleeve 14*c* and the like.

Figure 20:
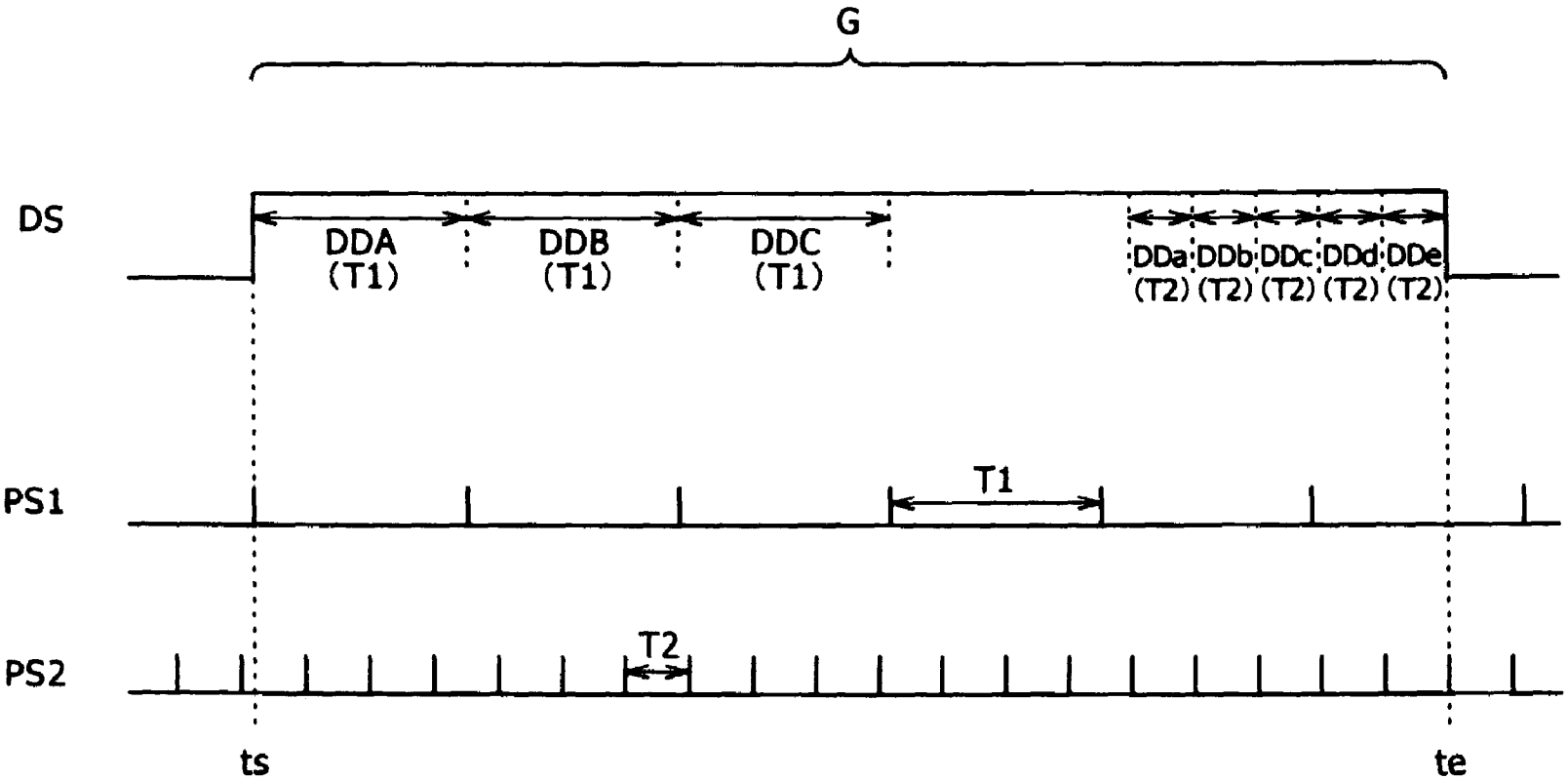
FIG. 20 is an explanatory view showing the relation among density data, a first phase signal and a second phase signal.

FIG. 20 is an explanatory view showing the processing at the above-described steps S404 and S409. FIG. 20 shows the density data (density detection signal DS) read from the density data storage part 111, the first phase signal PS1 detected by the first phase sensor 17 and the second phase signal PS2 detected by the second phase sensor 18.

First, at the above-described step S404, the data sampling part 113 samples the first density data DDA to DDC for three periods of the first period T1 of the photoconductor drum 11, with detection start time ts of the density detection signal DS as a base point. As described above, the detection start time ts is synchronized with the detection timing of the first mark M1 on the photoconductor drum 11. Accordingly, in the sampled first density data DDA to DDC, the respective origin points correspond to the formation position of the first mark M1 on the photoconductor drum 11.

On the other hand, at the above-described step S409, the data sampling part 113 samples the second density data DDa to DDe for five periods of the second period T2 of the developing sleeve 14*c*, with detection start time te of the density detection signal DS as a base point, in a reversing manner. As described above, the detection start time te is synchronized with the detection timing of the second mark M2 on the developing sleeve 14*c*. Accordingly, in the sampled second density data DDa to DDe, the respective origin points correspond to the formation position of the second mark M2 on the developing sleeve 14*c*.

In this manner, in the present exemplary embodiment, upon acquisition of the first light quantity correction data LC1, the formation of the correction image G is started at the detection timing of the first mark M1 on the photoconductor drum 11. The formation position of the first mark M1 on the photoconductor drum 11 can be easily linked to the front end Gs in the correction image G. Accordingly, even when images having different densities as in the first exemplary embodiment are not formed, the linking (synchronization) between the density data and the position on the photoconductor drum 11 in the slow-scanning direction can be easily made. Further, in the present exemplary embodiment, upon acquisition of the second light quantity correction data LC2, the formation of the correction image G is terminated at the detection timing of the second mark M2 on the developing sleeve 14*c*. The formation position of the second mark M2 on the developing sleeve 14*c* can be easily linked to the rear end Ge in the correction image G. Accordingly, even when images having different densities as in the first exemplary embodiment are not formed, the linking (synchronization) between the density data and the slow-scanning directional position on the developing sleeve 14*c* can be easily made.

Especially, in the present exemplary embodiment, the formation of the correction image G is started at the detection timing of the first mark M1 on the photoconductor drum 11, and the formation of the correction image G is terminated at the detection timing of the second mark M2 on the developing sleeve 14*c*. Accordingly, once the correction image G is formed, the first light quantity correction data LC1 and the second light quantity correction data LC2 can be obtained. Note that in FIG. 20, the first density data DDA to DDc and the second density data DDA to DDe are obtained from different data, however, both data may overlap with each other. In this case, the slow-scanning directional length of the correction image G for obtaining the first light quantity correction data LC1 and the second light quantity correction data LC2 can be further reduced.

Third Exemplary Embodiment

In this exemplary embodiment, the formation of the correction image is started in correspondence with the result of detection of the first mark M1 on the photoconductor drum 11 which functions as a first submodule, thereby the correction image is linked to the position on the photoconductor drum 11 in the slow-scanning direction. Note that the correction image is linked to the position on the developing sleeve 14*c* in the slow-scanning direction based on time difference (phase difference) between the detection timing of the first mark M1 and detection timing of the second mark M2 on the developing sleeve 14*c* which functions as a second submodule. Note that in the present exemplary embodiment, the constituent elements corresponding to those in the first exemplary embodiment have the same reference numerals and the detailed explanations thereof will be omitted.

Figure 21:
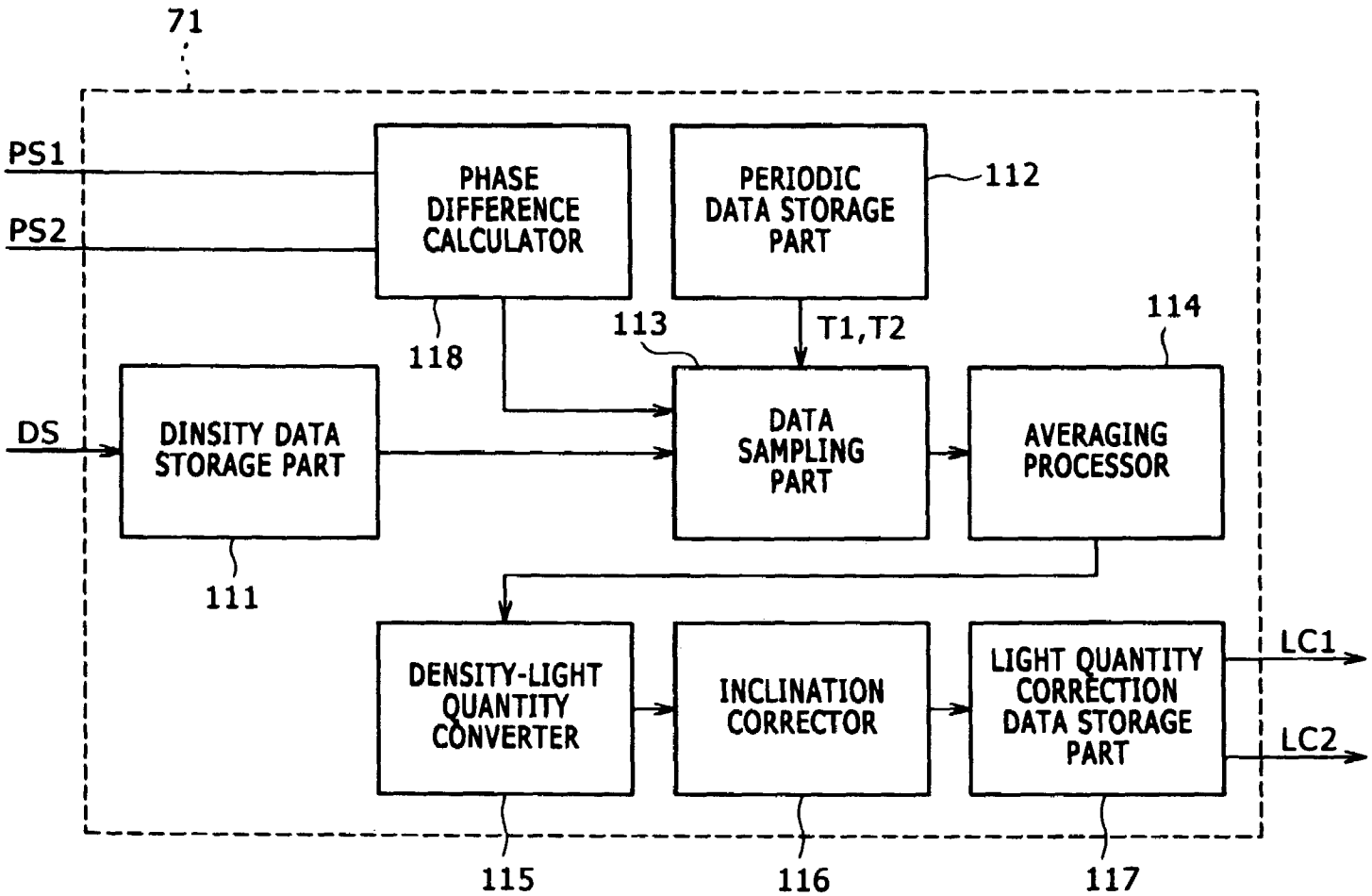
FIG. 21 is a block diagram showing the configuration of the correction setting part used in a third exemplary embodiment.

FIG. 21 is a block diagram showing the configuration of the correction setting part 71 used in the present exemplary embodiment. The difference from the second exemplary embodiment is that the correction setting part 71 further has a phase difference calculator 118. The first phase signal PS1 from the first phase sensor 17 which functions as a first phase detector and the second phase signal PS2 from the second phase sensor 18 are inputted into the phase difference calculator 118. The phase difference calculator 118 calculates a phase difference as a difference between the peak of the first phase signal PS1 and that of the second phase signal PS2, and outputs the difference to the data sampling part 113.

Figure 22:
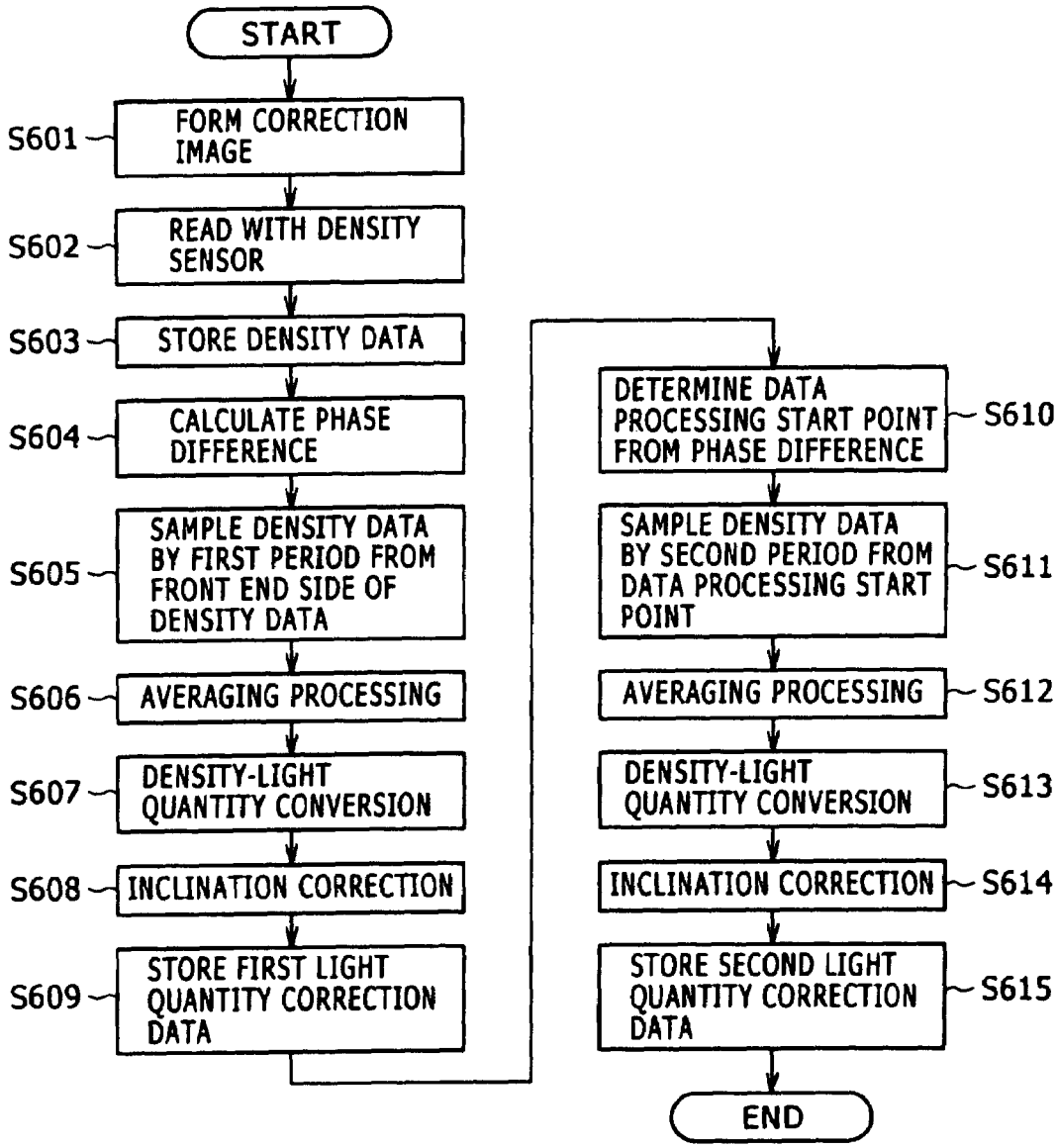
FIG. 22 is a flowchart showing the process of obtaining plural light quantity correction data pieces by the correction setting part according to the third exemplary embodiment.

FIG. 22 is a flowchart showing the process of obtaining the first light quantity correction data LC1 and the second light quantity correction data LC2 by the above-described correction setting part 71.

In this processing, first, the correction image is formed on the intermediate transfer belt 20 using the image forming apparatus (step S601). Note that the formed correction image is the same as that described in the second exemplary embodiment.

Next, the density of the toner image formed on the intermediate transfer belt 20 is read by the density sensor 28 (step S602), and the obtained density detection signal DS is outputted to the correction setting part 71. Then the correction setting part 71 receives the signal, and stores the density detection signal DS, as density data arrayed in the slow-scanning direction, into the density data storage part 111 (step S603).

On the other hand, the phase difference calculator 118 calculates a phase difference between the input first phase signal PS1 and the second phase signal PS2 (step S604). Note that the calculation of the phase difference is performed upon start of the formation of correction image, i.e., upon detection of the peak of the first phase signal PS1 after the instruction of formation of correction image (see FIGS. 18 and 19).

Then, the data sampling part 113 samples the first density data for plural rotations of the photoconductor drum 11 by the first period T 1 from the head of the density data read from the density data storage part 111 (step S605). Thereafter, the averaging processor 114 averages the plural first density data pieces by the same portion on the photoconductor drum 11 (step S606). Then, the density-light quantity converter 115 performs density-light quantity conversion on the first density data averaged by the averaging processor 114 (step S607). Further, the inclination corrector 116 performs inclination correction on the density-light quantity converted data (step S608), and outputs the result of inclination correction as the first light quantity correction data LC1. Then, the first light quantity correction data LC1 is stored into the light quantity correction data storage part 117 (step S609).

Next, the data sampling part 113 determines a data processing start point (step S610) from the phase difference obtained by the phase difference calculator 118 at step S604. Then, the data sampling part 113 samples the second density data for plural rotations of the developing sleeve 14*c* by the second period T2 with the data processing start point obtained at step S610 as a base point (step S611). Thereafter, the averaging processor 114 averages the plural second density data pieces by the same portion on the developing sleeve 14*c* (step S612). Then, the density-light quantity converter 115 performs density-light quantity conversion on the second density data averaged by the averaging processor 114 (step S613). Further, the inclination corrector 116 performs inclination correction on the density-light quantity converted data (step S614), and outputs the result of inclination correction as the second light quantity correction data LC2. Then, the second light quantity correction data LC2 is stored into the light quantity correction data storage part 117 (step S615).

Figure 23:
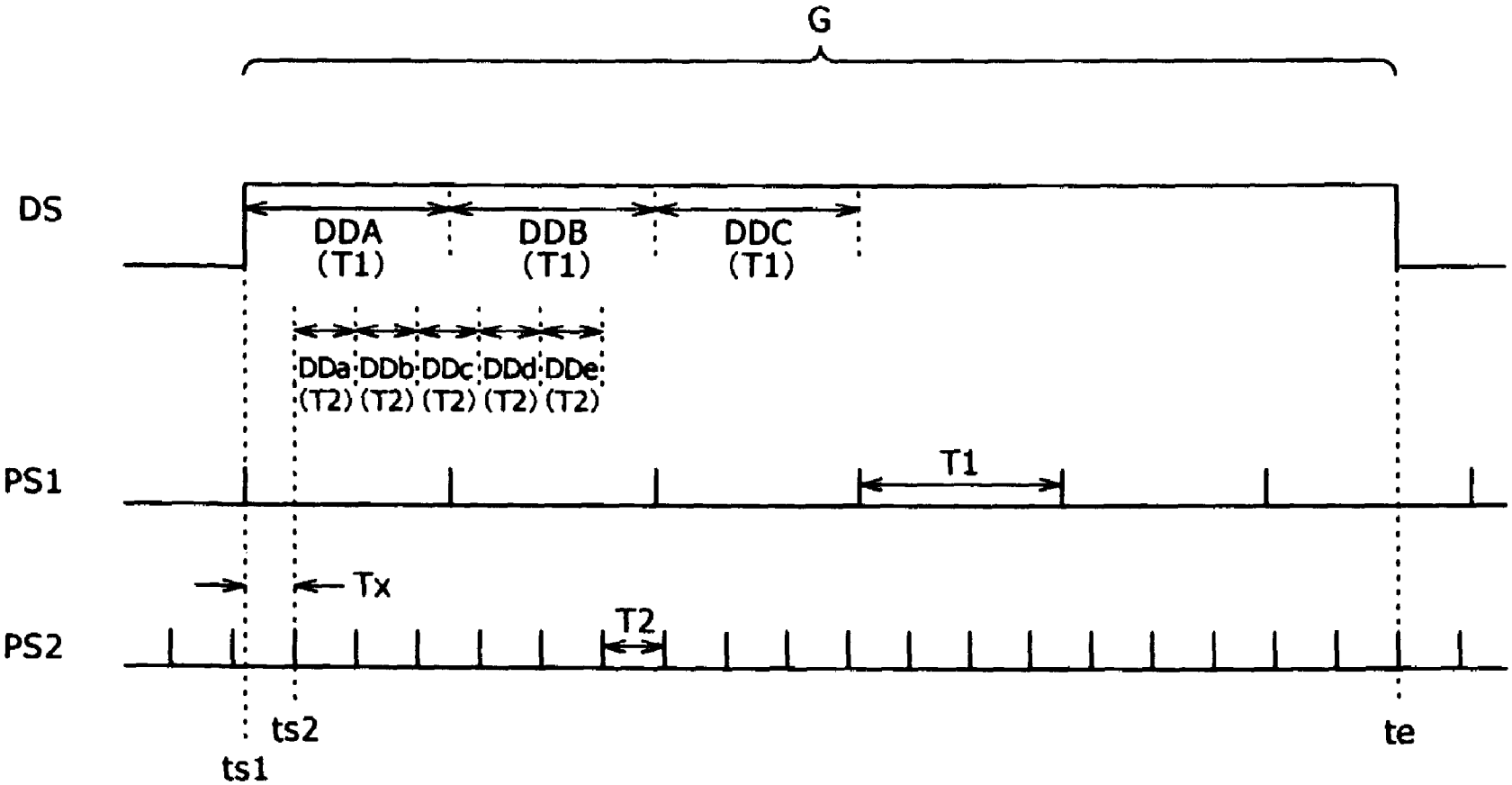
FIG. 23 is an explanatory view showing acquisition of the first density data and second density data.

FIG. 23 is an explanatory view showing the processing at the above-described steps S605 and S611. FIG. 23 shows the density data (density detection signal DS) read from the density data storage part 111, the first phase signal PS 1 detected by the first phase sensor 17 and the second phase signal PS2 detected by the second phase sensor 18.

First, at the above-described step S605, the data sampling part 113 samples the first density data DDA to DDC by three periods of the first period T1 of the photoconductor drum 11, with detection start time ts1 (referred to as "first time") of the density detection signal DS as a base point. As described above, the detection start time ts1 is synchronized with the detection timing of the first mark M1 on the photoconductor drum 11. Accordingly, in the sampled first density data DDA to DDC, the respective origin points correspond to the formation position of the first mark M1 on the photoconductor drum 11.

On the other hand, at the above-described step S611, the data sampling part 113 samples the second density data DDa to DDe for five periods of the second period T2 of the developing sleeve 14*c*, with time ts2 (referred to as "second time"), delayed from first time ts1 by a phase difference Tx calculated at the above-described step S604, as a base point. The second time ts2 is a time point delayed from the first time ts1 upon detection of the peak of the first phase signal PS1 by the phase difference Tx between the first phase signal PS1 and the second phase signal PS2. Accordingly, as apparently shown in FIG. 23, the second time ts2 is synchronized to the detection timing of the second mark M2 on the developing sleeve 14*c*. In the sampled second density data DDa to DDe, the respective origin points correspond to the formation position of the second mark M2 on the developing sleeve 14*c*.

In this manner, in the present exemplary embodiment, upon acquisition of the second light quantity correction data LC2, the position of sampling from the density data is detected utilizing the phase difference between the photoconductor drum 11 and the developing sleeve 14*c*. Accordingly, the linking (synchronization) between the density data and the position on the photoconductor drum in the slow-scanning direction can be more easily made.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus having a submodule that causes non-uniformity in density in a slow-scanning direction in accordance with rotation, comprising:

a correction image forming unit that forms an image for density correction, in cooperation with the submodule;

a density detector that detects a density of the image for density correction;

a correction data generation unit that generates correction data to correct a density distribution based on a density distribution of the image for density correction in a slow-scanning direction detected by the density detector;

a phase detector that detects a phase of the submodule; and a mark image forming unit that forms a mark image in synchronization with the phase of the submodule detected by the phase detector, in the image for density correction formed by the correction image forming unit.

2. The image forming apparatus according to claim 1, wherein the correction data generation unit links the density distribution of the image for density correction in the slow-scanning direction with a position of the submodule in the slow-scanning direction, based on a formation position of the mark image in the image for density correction.

3. The image forming apparatus according to claim 1, wherein the correction image forming unit forms a halftone image as the image for density correction, and the mark image forming unit forms a halftone image as the mark image having a density different from that of the image for density correction.

4. The image forming apparatus according to claim 1, comprising a plurality of the submodules, wherein the mark image forming unit forms a halftone image as the mark image having a density different from that of the image for density correction, for each of the submodules.

5. The image forming apparatus according to claim 1, wherein density correction is performed based on a density difference between the image for density correction and the mark image read by the density detector.

6. The image forming apparatus according to claim 1, wherein the mark image forming unit has an image signal generation unit that generates an image signal and an exposure unit that exposes an image carrier based on the image signal outputted from the image signal generation unit, and the exposure unit temporarily changes a light quantity in synchronization with detection of the phase by the phase detector.

7. The image forming apparatus according to claim 1, wherein the mark image forming unit has an image signal generation unit that generates an image signal and an exposure unit that exposes an image carrier based on the image signal outputted from the image signal generation unit, and the image signal generation unit temporarily changes the image signal in synchronization with detection of the phase by the phase detector.

8. An image forming apparatus having a submodule that causes non-uniformity in density in a slow-scanning direction in accordance with rotation, comprising:

a correction image forming unit that forms an image for density correction, in cooperation with the submodule;

a density detector that detects a density of the image for density correction;

a correction data generation unit that generates correction data to correct a density distribution based on a density distribution of the image for density correction in a slow-scanning direction detected by the density detector; and a phase detector that detects a phase of the submodule, wherein the correction image forming unit starts to form the image for density correction in synchronization with the phase of the submodule detected by the phase detector.

9. The image forming apparatus according to claim 8, wherein the correction data generation unit links the density distribution of the image for density correction in the slow-scanning direction with a position of the submodule in the slow-scanning direction, based on timing of start of detection of the image for density correction by the density detector.

10. The image forming apparatus according to claim 8, comprising a plurality of the submodules, wherein the correction image forming unit terminates formation of the image for density correction in synchronization with detection of a phase of another submodule by the phase detector.

11. The image forming apparatus according to claim 10, wherein the correction data generation unit links a density distribution of the image for density correction in the slow-scanning direction with a position of the another submodule in the slow-scanning direction, based on timing of termination of detection of the image for density correction by the density detector.

12. An image forming apparatus having a first submodule and a second submodule that cause non-uniformity in density in a slow-scanning direction in accordance with rotation, comprising:

a correction image forming unit that forms an image for density correction, in cooperation with the first submodule and the second submodule;

a density detector that detects a density of the image for density correction;

a correction data generation unit that generates correction data to correct a density distribution based on the density distribution of the image for density correction in a slow-scanning direction detected by the density detector;

a first phase detector that detects a phase of the first submodule; and a second phase detector that detects a phase of the second submodule, wherein the correction image forming unit starts to form the image for density correction in synchronization with the phase of the first submodule detected by the first phase detector, and the correction data generation unit links the density distribution of the image for density correction in the slow-scanning direction with a position of the first submodule in the slow-scanning direction, based on timing of start of detection of the image for density correction by the density detector, and links the density distribution of the image for density correction in the slow-scanning direction with a position of the second submodule in the slow-scanning direction, based on the timing of start of detection and a phase difference between the phase of the first submodule detected by the first phase detector and the phase of the second submodule detected by the second phase detector.

13. The image forming apparatus according to claim 12, wherein the first submodule is a photoconductive member having a photoconductive layer, and the second submodule is a developing part that develops an electrostatic latent image on the photoconductive member with toner.

14. An image density correction device comprising:

a correction image forming unit that forms an image for density correction, in cooperation with a submodule that rotates;

a phase detector that detects a phase of the submodule;

a mark image forming unit that forms a mark image in synchronization with the phase of the submodule detected by the phase detector, in the image for density correction formed by the correction image forming unit;

a density detector that detects a density of the image for density correction and the mark image; and a correction data generation unit that generates correction data to correct a density distribution based on a density distribution of the image for density correction in a rotating direction of the submodule detected by the density detector.

15. The image density correction device according to claim 14, wherein the correction data generation unit links the density distribution of the image for density correction in the rotating direction of the submodule with a position of the submodule in the rotating direction, based on a formation position of the mark image in the image for density correction.

16. The image forming apparatus according to claim 14, wherein the correction image forming unit forms a halftone image as the image for density correction, and the mark image forming unit forms a halftone image as the mark image having a density different from that of the image for density correction.

17. The image forming apparatus according to claim 14, comprising a plurality of the submodules, wherein the mark image forming unit forms a halftone image as the mark image having a density different from that of the image for density correction, for each of the submodules.

18. The image forming apparatus according to claim 14, wherein density correction is performed based on a density difference between the image for density correction and the mark image read by the density detector.

19. The image forming apparatus according to claim 14, wherein the mark image forming unit has an image signal generation unit that generates an image signal and an exposure unit that exposes the submodule based on the image signal outputted from the image signal generation unit, and the exposure unit temporarily changes a light quantity in synchronization with detection of the phase by the phase detector.

20. The image forming apparatus according to claim 14, wherein the mark image forming unit has an image signal generation unit that generates an image signal and an exposure unit that exposes the submodule based on the image signal outputted from the image signal generation unit, and the image signal generation unit temporarily changes the image signal in synchronization with detection of the phase by the phase detector.

* * * * *